US011560761B2

(12) United States Patent
Slack

(10) Patent No.: US 11,560,761 B2
(45) Date of Patent: Jan. 24, 2023

(54) VARIABLE-LENGTH AXIAL LINKAGE FOR TUBULAR RUNNING TOOLS

(71) Applicant: NOETIC TECHNOLOGIES INC., Edmonton (CA)

(72) Inventor: Maurice William Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 0 days.

(21) Appl. No.: 17/634,303

(22) PCT Filed: Oct. 26, 2021

(86) PCT No.: PCT/CA2021/000096

§ 371 (c)(1),
(2) Date: Feb. 10, 2022

(87) PCT Pub. No.: WO2022/087707

PCT Pub. Date: May 5, 2022

(65) Prior Publication Data

US 2022/0316284 A1 Oct. 6, 2022

Related U.S. Application Data

(60) Provisional application No. 63/235,650, filed on Aug. 20, 2021, provisional application No. 63/105,786, filed on Oct. 26, 2020.

(51) Int. Cl.
*E21B 17/07* (2006.01)
*E21B 17/042* (2006.01)
(Continued)

(52) U.S. Cl.
CPC ..... *E21B 17/07* (2013.01); *E21B 17/046* (2013.01); *E21B 17/0423* (2013.01); *E21B 19/16* (2013.01)

(58) Field of Classification Search
CPC .... E21B 19/16; E21B 17/0423; E21B 17/046; E21B 17/07
See application file for complete search history.

(56) References Cited

U.S. PATENT DOCUMENTS 8,424,939 B2 4/2013 Slack
8,454,066 B2 6/2013 Slack
(Continued)

OTHER PUBLICATIONS

International Search Report re PCT/CA2021/000096, completed by the ISA/CA on Dec. 9, 2021, and mailed by the ISA/CA dated Jan. 25, 2022.
(Continued)

*Primary Examiner* — Shane Bomar
(74) *Attorney, Agent, or Firm* — Donald V. Tomkins

(57) ABSTRACT

An axial linkage acting between the main body and the gripping assembly of a tool for gripping tubular workpieces includes a drive cam body that coaxially engages an intermediate cam body via a drive thread, with the intermediate cam body coaxially engaging a driven cam body via a driven thread, and with the drive thread and the driven thread having opposite orientations. The linkage includes a latch mechanism for preventing relative axial displacement of the drive cam body and the driven cam body. In operation while unlatched, the linkage converts bi-directional relative rotation into relative axial movement of the drive cam body and the driven cam body, thus increasing or decreasing the overall length of the linkage according to the rotational direction. The linkage can be re-latched using any of multiple operational sequences.

12 Claims, 31 Drawing Sheets

(51) Int. Cl.
*E21B 17/046* (2006.01)
*E21B 19/16* (2006.01)

(56) References Cited

U.S. PATENT DOCUMENTS

| | | | | |
|---|---|---|---|---|
| 9,869,143 | B2 * | 1/2018 | Slack | E21B 3/022 |
| 9,896,891 | B2 * | 2/2018 | Mullins | E21B 19/00 |
| 10,081,989 | B2 | 9/2018 | Slack | |
| 11,332,985 | B1 * | 5/2022 | Slack | E21B 19/06 |
| 2008/0210063 | A1 * | 9/2008 | Slack | E21B 19/06 81/420 |
| 2009/0114398 | A1 * | 5/2009 | Buytaert | E21B 33/1291 166/380 |
| 2009/0273201 | A1 * | 11/2009 | Slack | E21B 19/07 294/86.25 |
| 2010/0326647 | A1 | 12/2010 | Moody | |
| 2018/0363389 | A1 * | 12/2018 | Þorbjörnsson | F16L 15/00 |
| 2019/0119993 | A1 * | 4/2019 | Haynes | E21B 17/07 |
| 2020/0131864 | A1 | 4/2020 | Slack | |
| 2021/0355764 | A1 * | 11/2021 | Slack | E21B 23/006 |
| 2022/0259930 | A1 * | 8/2022 | Slack | E21B 19/07 |

OTHER PUBLICATIONS

Written Opinion of the International Searching Authority re PCT/CA2021/000096, completed by the ISA/CA on Jan. 12, 2022, and mailed by the ISA/CA dated Jan. 25, 2022.

* cited by examiner

VARIABLE-LENGTH AXIAL LINKAGE FOR TUBULAR RUNNING TOOLS

FIELD

The present disclosure relates in general to tools or devices for gripping tubular workpieces and transferring both axial and torsional loads to the workpieces. In particular, the present disclosure relates to gripping tools for use in the fields of earth drilling, well construction, and well servicing with drilling and service rigs, such as casing running tools mountable to the top drive of a drilling rig for gripping segments of casing strings being assembled into, deployed in, or removed from a wellbore.

BACKGROUND

The traditional method for running casing or other tubing strings into or out of petroleum wells has been to use power tongs in coordination with the drilling rig's hoisting system. This power tong method allows tubular strings, made up of multiple segments (or "joints") of pipe with mating threaded ends, to be assembled by screwing together the threaded ends to form threaded connections between sequential joints as they are added to the string being installed in the wellbore (i.e., connection "make-up"); or, conversely, removed and disassembled (i.e., connection "break-out").

However, the power tong method does not simultaneously enable other beneficial functions such as rotating, pushing, or fluid filling after a joint is added to or removed from the string, and while the string is being lowered or raised in the wellbore. Running tubulars with power tongs also typically requires the presence of personnel in hazardous locations such as on the rig floor or more significantly, above the rig floor, on what is commonly called the "stabbing board".

The advent of drilling rigs equipped with top drives has enabled a new method of running tubulars, and casing in particular, where the top drive is equipped with a casing running tool (CRT) to grip the upper joint of the casing string and, in some cases, to seal between the casing and the top drive quill. (It should be understood here that the term top drive quill is generally meant to include tubular string components as may be attached thereto, with the lower end thereof effectively acting as an extension of the quill.) Various CRT devices have been developed which, when used with a top drive, enable hoisting, rotating, pushing, and filling of the casing string with drilling fluid while running, thus removing the limitations associated with power tongs. Simultaneously, automation of the gripping mechanism, combined with the inherent advantages of the top drive, reduces the level of human involvement required compared with conventional power tong running processes, and thus improves safety.

When running casing with either power tongs or CRTs, the full weight of the casing string extending below the drill floor of the drilling rig is typically supported by slips provided in the drill floor while a casing joint (the "active joint") is being added to or removed from the string. As well, make-up torque and break-out torque applied to the active joint must also be reacted out of the assembled string; this function is typically provided either by the slips or by backup tongs, as the case may be.

U.S. Pat. No. 7,909,120 (Slack) discloses a gripping tool that has been used as a CRT, and which may be summarized in general terms as a gripping tool comprising:

- a main body assembly (or, more briefly, the main body) having a load adaptor adapted for connection to a drive head such as a top drive quill;
- a gripping assembly carried by the main body, having at least one grip surface adapted to move from a radially-retracted position to a radially-extended position in which the grip surface engages either an interior surface or an exterior surface of a tubular workpiece upon axial displacement of the main body relative to the grip surface in at least one axial direction; and
- a linkage acting between the main body and the gripping assembly which translates at least one range of rotational movement in at least one rotational direction into axial movement that tends to urge the grip surface into the engaged position (i.e., gripping a tubular workpiece), and which upon activation exerts an axial force that increases with increased torque, and correspondingly activates radially compressive tractional engagement of the grip surface with the workpiece, with the rotational movement to activate the linkage being bi-diretional—i.e., either clockwise or counter-clockwise rotation of the load adaptor relative to the grip surface.

This gripping tool thus utilizes a mechanically-activated grip mechanism that generates its gripping force in response to axial-stroke activation of the gripping assembly. Axial-stroke activation results from one or more of:

- the action of an internal spring, which may be an air spring;
- gravity;
- externally-applied axial load; and
- externally-applied torsional load, in the form of right-hand or left-hand torque.

The externally-applied axial or torsional loads are carried through the tool from the load adaptor of the main body to the grip surface of the gripping assembly, in tractional engagement with the workpiece. As will be apparent to persons of ordinary skill in the art, the utility of this or other similar gripping tools is a function of the range of workpiece sizes (typically expressed in terms of minimum and maximum diameters for tubular workpieces) that can be accommodated between the fully-retracted and fully-extended grip surface positions of a given gripping tool (i.e., the radial size and radial stroke of the grip surface). The utility of a given gripping tool can be improved if it can accommodate a greater range of workpiece sizes.

U.S. Pat. No. 8,424,939 (Slack) discloses a gripping tool incorporating a tri-cam linkage with two cam pairs to translate bi-directional rotation into axial movement that has the effect of extending the length of the linkage and thus drives axial-stroke activation of the tool's gripping assembly. The axial operating range of this prior art axial extension linkage is limited by the helical ramp surfaces acting between an intermediate cam body and a driven cam body. This prior art linkage also comprises mating latch hooks (or a "J-latch" mechanism) that, when engaged, prevent relative axial separation of the drive cam and the driven cam, thus preventing extension of the linkage.

BRIEF SUMMARY OF THE DISCLOSURE

In general terms, the present disclosure teaches non-limiting embodiments of a variable-length axial linkage for tubular running tools that can provide operational advantages over prior art linkages such as those disclosed in U.S. Pat. Nos. 7,909,120 and 8,424,939, including one or more of the following:

greater axial operating range for a given diameter of tubular;

the ability to transfer both compressive and tensile axial loads when unlatched (instead of transferring only compressive axial load when unlatched); and the ability to re-latch using any of several alternative operational sequences (instead of being re-latchable only following one specific operational sequence).

Embodiments of linkages in accordance with the present disclosure may be configured for retrofitting into prior art gripping tools such as (but not limited to) those disclosed in U.S. Pat. No. 7,909,120, replacing the prior art linkages therein.

As a matter of convention, the present disclosure uses the terms "drive cam body" and "driven cam body" and, similarly, "drive cam threads" and "driven cam threads", as a convenience to provide naming references for components and features of embodiments of linkages in accordance herewith. For example, the terms "drive cam body" and "driven cam body" are intended to be understood in the sense that load (or displacement) applied to the drive cam body transmits load (or displacement) to (i.e., "drives") the driven cam body. This convention is not intended to be restrictive; rather, the relative motions and forces of the systems being described can be inverted without departing from the intended meaning and scope of the present disclosure.

In one exemplary embodiment, a variable-length axial linkage in accordance with the present disclosure comprises:

a drive cam body;

an intermediate cam body;

a driven cam body; and a latch mechanism;

wherein:

the drive cam body and the intermediate cam body are threadingly engaged via a drive thread having a drive thread threadform and a drive thread lead angle;

the drive thread threadform defines drive thread tension flanks having a drive thread tension flank angle;

the linkage comprises a primary drive thread stop;

the intermediate cam body and the driven cam body are threadingly engaged via a driven thread having a driven thread threadform and a driven thread lead angle;

the linkage comprises a primary driven thread stop;

a selected one of the drive thread and the driven thread is a left-handed thread;

the non-selected one of the drive thread and the driven thread is a right-handed thread;

the lead angles and threadforms of the drive thread and the driven thread are selected, taking frictional properties into consideration as appropriate, such that axial load transmitted through the linkage will urge the intermediate cam body to rotate, and thus cause the overall length of the linkage to change within a selected range when the latch mechanism is unlatched;

the primary drive thread stop is configured to be non-jamming and to limit the amount of rotation of the drive thread in a selected rotational direction (i.e., clockwise or counter-clockwise); and the primary driven thread stop is configured to be non-jamming and to limit the amount of rotation of the driven thread in the non-selected rotational direction (i.e., the rotational direction opposite to the selected rotational direction).

Accordingly, a variable-length axial linkage in accordance with the present disclosure acts between the main body and the gripping assembly of a gripping tool to convert bi-directional rotation of the load adaptor (i.e., either clockwise or counter-clockwise rotation) relative to the grip surface(s) of the gripping assembly into axial movement to drive axial-stroke activation of the gripping assembly, while still allowing axial stroke of the load adaptor (relative to the gripping assembly), to also cause activation of the gripping assembly independent of rotation. It will be apparent to one skilled in the art that because this axial movement can only occur correlative with rotation of the intermediate cam body, the rate of change of axial movement will be affected by inertia and so component inertia must be considered in the context of the applied axial load in a given application to ensure a satisfactory response time.

For purposes of this disclosure, the term "thread" is used to denote a threaded connection between two coaxial components, and references to "movement" of a thread are to be understood as denoting relative rotation and consequent axial displacement of the two components engaged by the thread in question.

As used above and elsewhere in the present disclosure, the term "non-jamming" is intended to be understood as meaning that when a thread stop is engaged due to the application of axial load and/or torque in a first direction, then the thread stop will freely disengage if the direction of the applied load is reversed.

In some embodiments, the latch mechanism may comprise a J-latch mechanism which, when engaged, prevents relative axial separation of the drive cam and the driven cam and in turn prevents axial length change of the linkage.

In other embodiments, the latch mechanism may comprise:

a latch body carried by the intermediate cam body and slidingly axially movable relative to the intermediate cam body between a first (or "latching") position and a second (or "free") position (as defined below);

a striker body carried by the driven cam body and slidingly axially movable relative to the driven cam body within defined limits; and a first biasing means acting between the striker body and the driven cam body so as to bias the striker body toward a "latching" position and engagement with the latch body.

As used above and elsewhere in the present disclosure, the term "latching position" with reference to a given component is intended to be understood as meaning that the component in question is "ready to latch" or "ready for latching", in contradistinction to the term "latched position" in which the component in question is latched.

When the drive cam body is moved to a "latching" position relative to the intermediate cam body, mating cam surfaces on the drive cam body and the latch body will come into contacting sliding engagement so as to move the latch body to its first (or "latching") position on the intermediate cam body and then to hold it in that latching position. When the latch body is in its latching position on the intermediate cam body, it may engage the striker body. When the drive cam body is not in its "latching" position relative to the intermediate cam body, the cam surfaces permit the latch body to move to its second (or "free") position on the intermediate cam body. When the latch body is in its free position on the intermediate cam body, the latch body cannot engage the striker body.

The linkage may further comprise a second biasing means (such as, by way of non-limiting example, a mechanical spring) to urge the latch body toward its free position on the intermediate cam body.

The latch body has a latch surface configured for mating engagement with a latch surface on the striker body. Mating engagement occurs when the latch body is in its latching position, the striker body is in its latching position, and the linkage is axially positioned at the limit of its operating range defined by engagement of both the primary drive thread stop and the primary driven thread stop. The striker body is urged toward its latching position and engagement with the latch body by the first biasing means.

When the latch body and the striker body are in mating engagement, the latch body and the striker body will resist movement of the driven thread (i.e., they will resist relative movement between the intermediate cam body and the driven cam body). The geometries of the driven thread, the sliding of the striker body on the driven cam body, and the mating latch surfaces on the latch body and the striker body, as well as the force of the first biasing means urging the striker body toward engagement with the latch body, may be selected such that the latch body and the striker body either will disengage at selected combinations of axial load and torque applied to the linkage, or will not tend to disengage.

The linkage is considered to be "latched" and in its "latched position" when:

- the latch body is in mating engagement with the striker body, which requires that:
  - the latch body is in its latching position;
  - the striker body is in its latching position; and
  - the driven thread is axially positioned at the limit of its operating range defined by engagement of the primary driven thread stop; and
- the drive cam body is in its latching position, holding the latch body in its latching position.

The linkage is considered to be "unlatched" and in an "unlatched position" when any one of the above conditions is not met.

The linkage may further comprise a secondary driven thread stop, wherein a shoulder surface on the latch body and a shoulder surface on the driven cam body are configured for contacting engagement so as to limit the operating range of the driven thread in the selected rotational direction when the latch body is in its free position.

The linkage may further comprise a secondary drive thread stop, wherein a shoulder surface on the drive cam body and a shoulder surface on the intermediate cam body are configured for contacting engagement so as to limit the operating range of the drive thread in the non-selected rotational direction.

Prior art gripping tools such as those taught by U.S. Pat. No. 7,909,120 may include an internal spring acting in combination with gravity to stroke the gripping assembly toward engagement with a workpiece. When a linkage in accordance with the present disclosure is configured for use in such a prior art gripping tool and is latched, the force of the internal spring and gravity may be transmitted through the linkage as a tensile axial force urging movement of both the drive thread and the driven thread.

Mating engagement of the latch body and the striker body will resist movement of the driven thread as described previously in this disclosure. Movement of the drive thread will be resisted by friction between the tension flanks of the drive thread. However, unintentional unlatching of the linkage and consequent unintended activation of the gripping tool could occur when the resistance to rotary unlatching movement of the drive thread generated by friction between the tension flanks is low enough to allow rotation under application of axial load in the absence of externally-applied torque (i.e., "free rotation"). To avoid this potential problem, the frictional resistance to free rotation may be increased by increasing the angle of the tension flanks. (In this context, the thread flank angle means the included angle between the thread flank and a line perpendicular to the thread axis measured in a plane containing the thread axis.)

When the linkage is unlatched and operated to translate bi-directional rotation of the load adaptor relative to the grip surface into axial movement to drive axial-stroke activation of the gripping assembly, a compressive axial force will be generated in the linkage and transmitted through the compression flanks of the drive thread. It may be desirable to reduce the frictional resistance to rotary movement of the drive thread when the linkage transmits compressive force, and this may be achieved by decreasing the angle of the compression flanks.

Accordingly, asymmetric threadforms may be selected with the angle of the tension flanks differing in magnitude from the angle of the compression flanks.

The particular embodiments described and illustrated in the present disclosure for use in tubular running tools translate bi-directional rotation into axial extension (i.e., elongation) of the variable-length axial linkage and therefore may be referred to as "axial extension" linkages. The present disclosure also describes and illustrates a variant embodiment of a variable-length axial linkage configured to translate bi-directional rotation into axial retraction (i.e., contraction in overall length) of the linkage, and therefore such linkages may be referred to as "axial retraction" linkages.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Figure 1A:
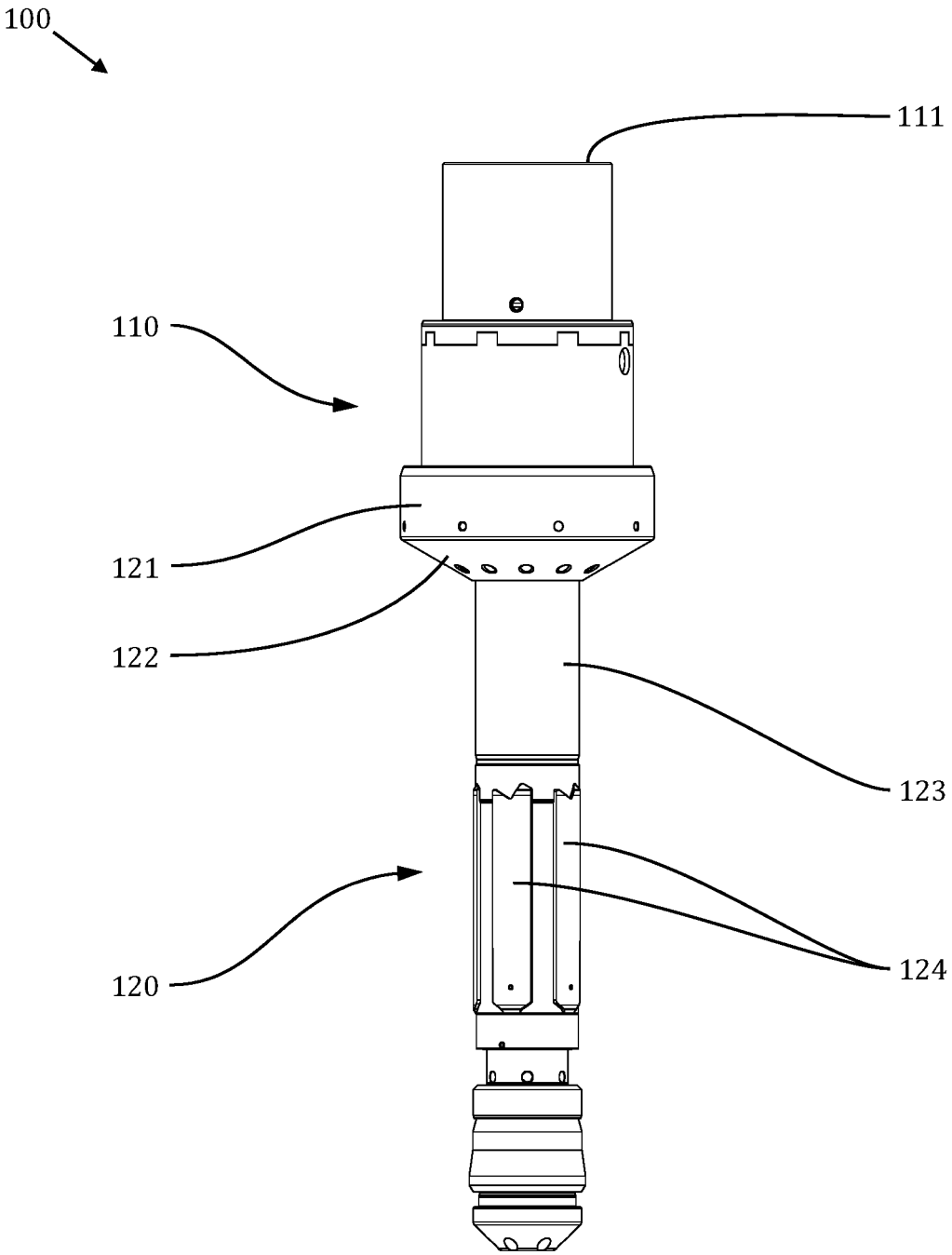
Figure 1A (prior art)
FIGS. 1A and 1B, respectively, are elevation and cross-section views of a prior art internally-gripping casing running tool (CRTi) essentially corresponding to the CRTi shown in FIGS. 48 and 49 of U.S. Pat. No. 8,424,939.
Figure 1B:
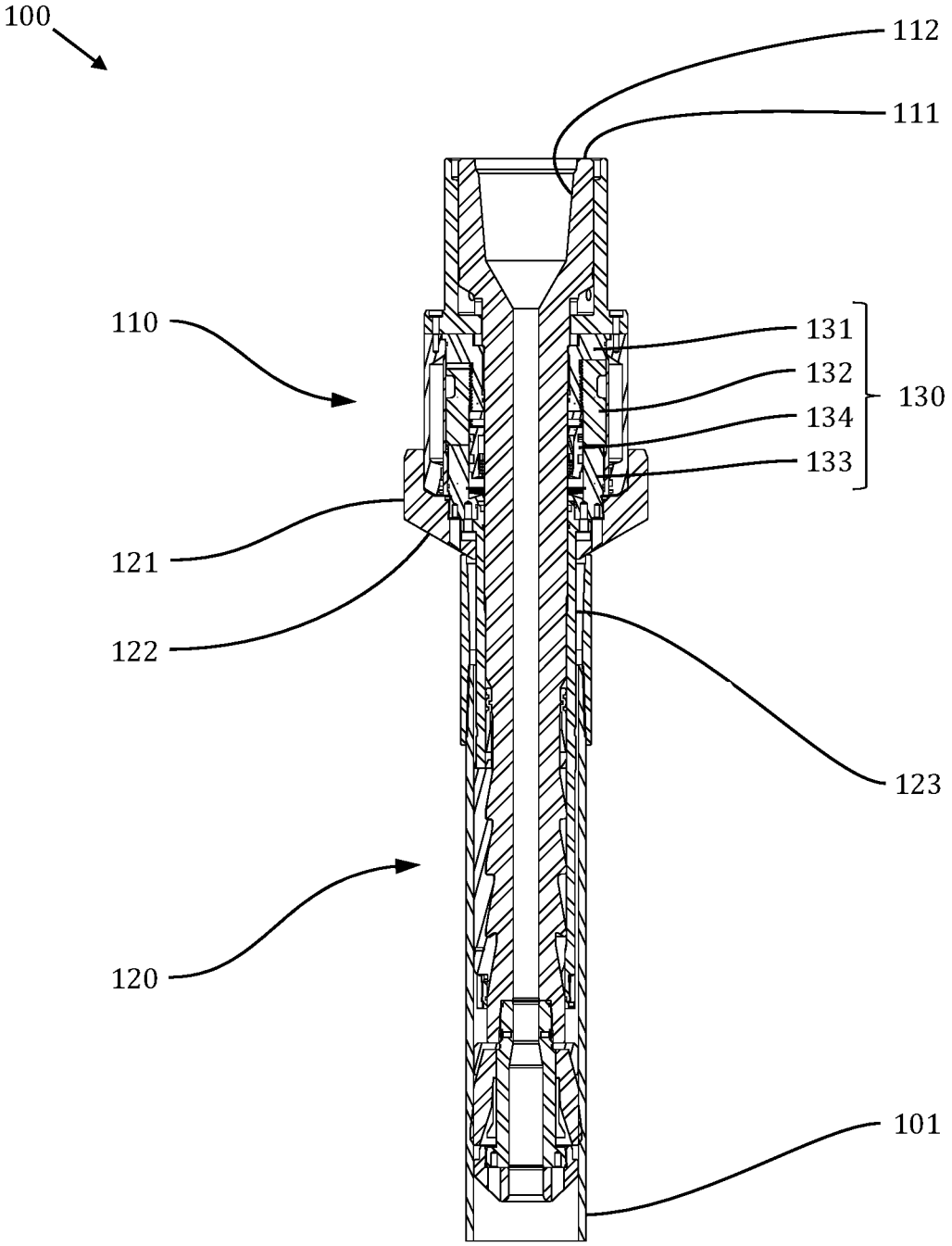
Figure 1B (prior art)

FIGS. 1A and 1B, respectively, are elevation and cross-section views of a prior art internally-gripping casing running tool (CRT) 100 substantially corresponding to the CRTi shown in FIGS. 48 and 49 of U.S. Pat. No. 8,424,939. CRT 100 comprises a main body assembly 110, a gripping assembly 120, and a prior art axial extension linkage 130. The upper end of main body assembly 110 is provided with a load adaptor 111, illustrated by way of non-limiting example as having a conventional tapered-thread connection 112 for structural connection to a top drive quill (not shown) of a top-drive-equipped drilling rig (not shown). Gripping assembly 120 comprises a land surface 122 that is carried by a bumper 121 attached to a cage 123, and grip surfaces 124 that are carried by and axially and rotationally linked to cage 123. CRT 100 is shown in FIG. 1B as it would appear in the latched position and inserted into a tubular workpiece 101 (shown in partial cutaway view). In this latched position, relative axial movement between main body assembly 110 and gripping assembly 120 is prevented by axial extension linkage 130, such that gripping assembly 120 is held in its retracted position.

Figure 2A:
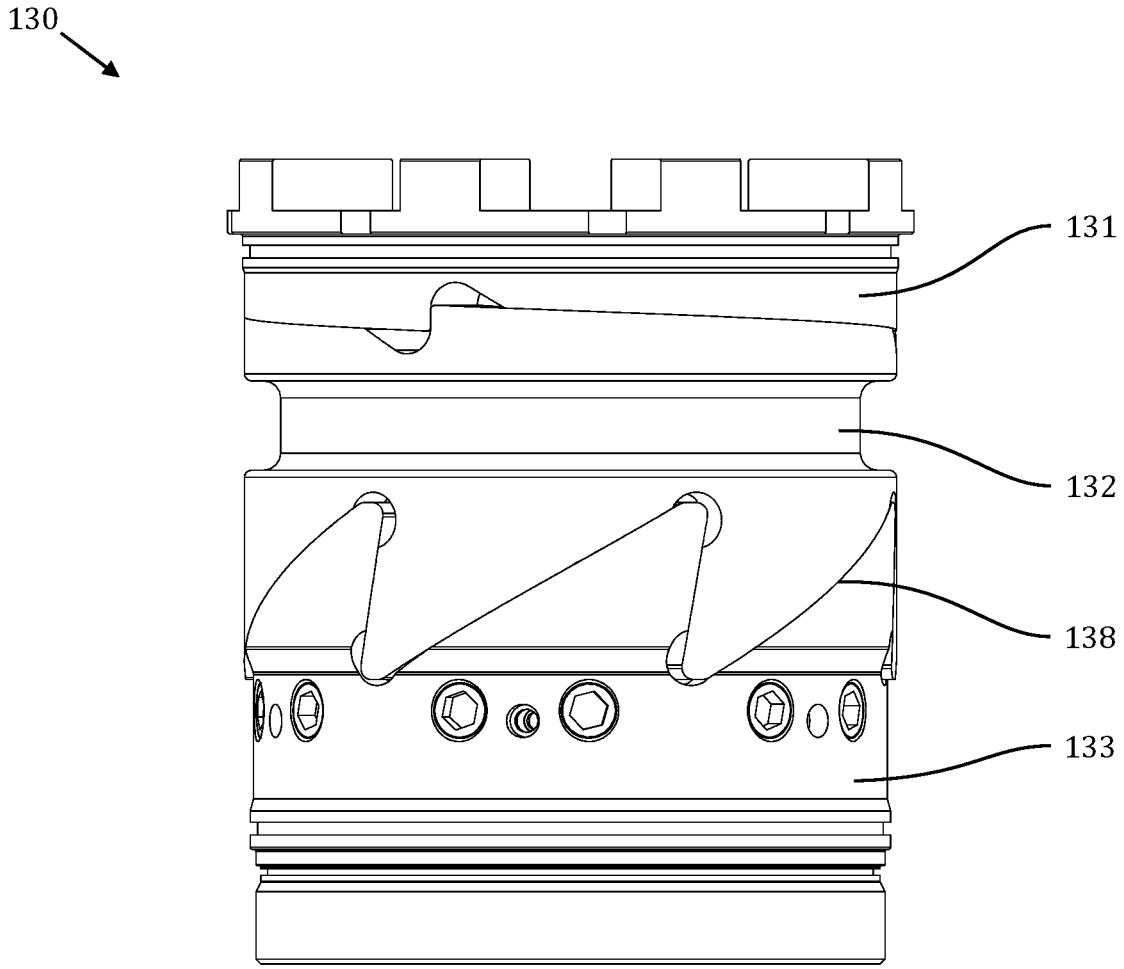
Figure 2A (prior art)
FIGS. 2A and 2B, respectively, are elevation and cross-section views of a prior art axial extension linkage installed in the CRTi of FIGS. 1A and 1B, and substantially corresponding to the linkage shown in FIGS. 50A and 50B of U.S. Pat. No. 8,424,939.
Figure 2B:
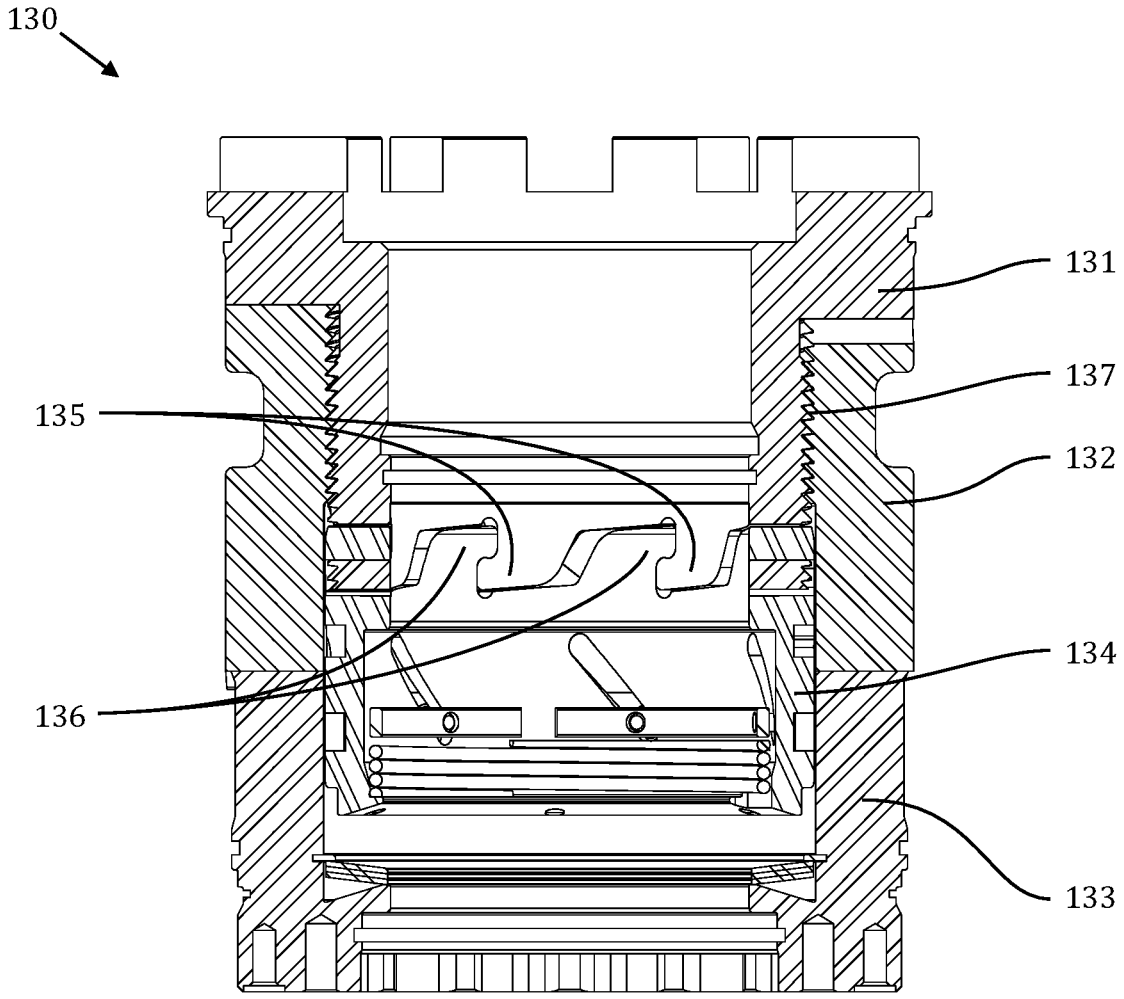
Figure 2B (prior art)

FIGS. 2A and 2B, respectively, are elevation and cross-section views of prior art axial extension linkage 130 substantially corresponding to the linkage shown in FIGS. 50A and 50B of U.S. Pat. No. 8,424,939. Axial extension linkage 130 comprises a drive cam body 131, an intermediate cam body 132, a driven cam body 133, and a cam latch body 134. A drive thread 137 comprises an external multi-start left-handed thread on drive cam body 131 engaging an internal multi-start left-handed thread on intermediate cam body 132. A driven helical ramp 138 comprises a plurality of helical right-handed ramp surfaces on intermediate cam body 132 engaging a plurality of helical right-handed ramp surfaces on driven cam 133 and acting in opposition to drive thread 137.

Axial extension linkage 130 acts between main body assembly 110 and gripping assembly 120 of CRT 100. Drive cam body 131 is carried by main body assembly 110 and linked to load adaptor 111 so as to be substantially fixed against rotation and axial movement relative to load adaptor 111. Driven cam body 133 is carried by gripping assembly 120 and linked to cage 123 so as to be substantially fixed against rotation and axial movement relative to cage 123. Cam latch body 134 is carried by driven cam body 133 and constrained to move axially relative to driven cam body 133 within defined limits. When CRT 100 is in the latched position, a plurality of drive cam hooks 135 on drive cam body 131 engage a corresponding plurality of cam latch hooks 136 on cam latch body 134 so as to restrict relative axial movement between main body assembly 110 and gripping assembly 120, and thus to hold gripping assembly 120 in its retracted position. This configuration of mating latch hooks formed by drive cam hooks 135 and cam latch hooks 136 is commonly known as a "J-latch" mechanism and will be familiar to persons of ordinary skill in the art.

CRT 100 is configured to move to an unlatched position in response to right-hand rotation of main body assembly 110 relative to gripping assembly 120, with the latch actuation torque corresponding to this rotary movement and applied to load adaptor 111 by the top drive being reacted by tractional engagement of land surface 122 with workpiece 101. Such right-hand rotation of main body assembly 110 relative to gripping assembly 120 causes drive cam hooks 135 and cam latch hooks 136 to disengage, permitting axial stroking of axial extension linkage 130 and corresponding relative axial movement between main body assembly 110 and gripping assembly 120, which in turn causes grip surfaces 124 of gripping assembly 120 to extend radially and grip workpiece 101.

When axial extension linkage 130 is unlatched and axially extended such that drive cam hooks 135 cannot engage cam latch hooks 136, drive thread 137 and driven helical ramp 138 will translate bi-directional rotation of load adaptor 111, in either the clockwise direction or the counter-clockwise direction respectively, relative to grip surface 124, into axial elongation ("extension") of axial extension linkage 130 to drive axial-stroke activation of gripping assembly 120.

Figure 3:
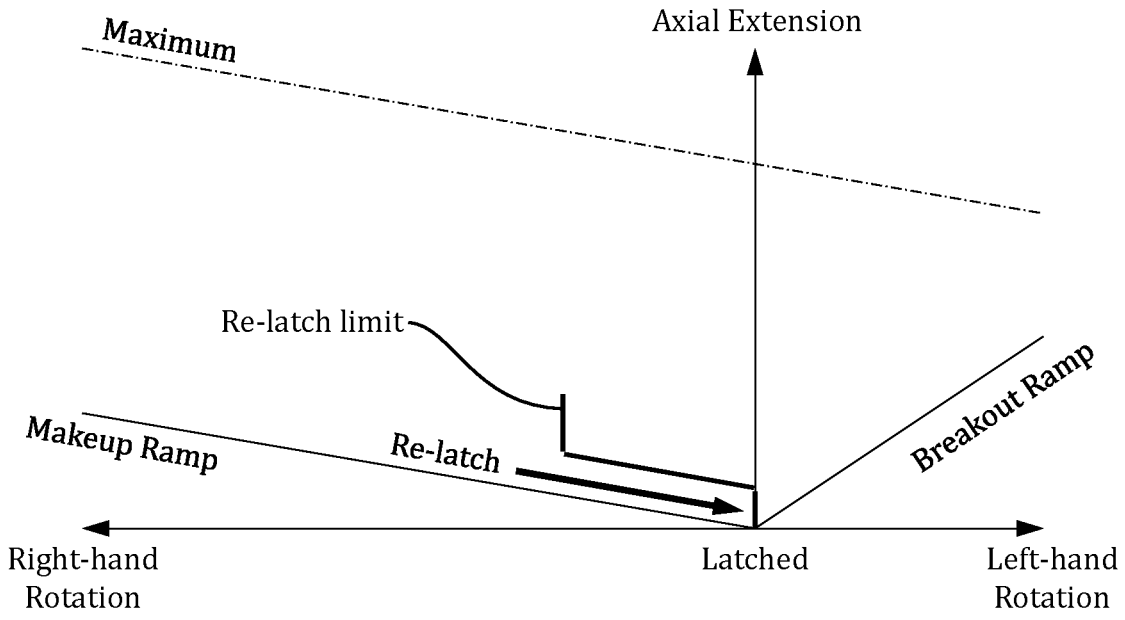
Figure 3 (prior art)
FIG. 3 is a graphical representation of a portion of the operating range of the prior art axial extension linkage in FIG. 2A.

FIG. 3 is a graphical representation of a portion of the operating range of prior art axial extension linkage 130. The makeup ramp line shown in FIG. 3 corresponds to the drive cam pair, and the breakout ramp line corresponds to the driven cam pair (i.e., the "helical ramp surfaces"), of axial extension linkage 130. To release workpiece 101 and re-engage drive cam hooks 135 with cam latch hooks 136, a specific sequence of operational steps must be followed as generally denoted by the arrow labelled "Re-latch" in FIG. 3, and as described below:

a) the top drive to which CRT 100 is mounted must be rotated in the right-hand direction until the rotational position of drive cam 131 is past a re-latch limit relative to driven cam 133;
b) the top drive then must be lowered to compress axial extension linkage 130 until the positional state of axial extension linkage 130 is on the make-up ramp line; and
c) the top drive then must be simultaneously rotated in the left-hand direction and lowered to follow the make-up ramp line to the latched position, at which point drive cam hooks 135 and cam latch hooks 136 are engaged.

After completing this operational sequence, axial extension linkage 130 is latched and the engaged drive cam hooks 135 and cam latch hooks 136 will hold gripping assembly 120 in its retracted position, allowing CRT 100 to be removed from workpiece 101.

Figure 4:
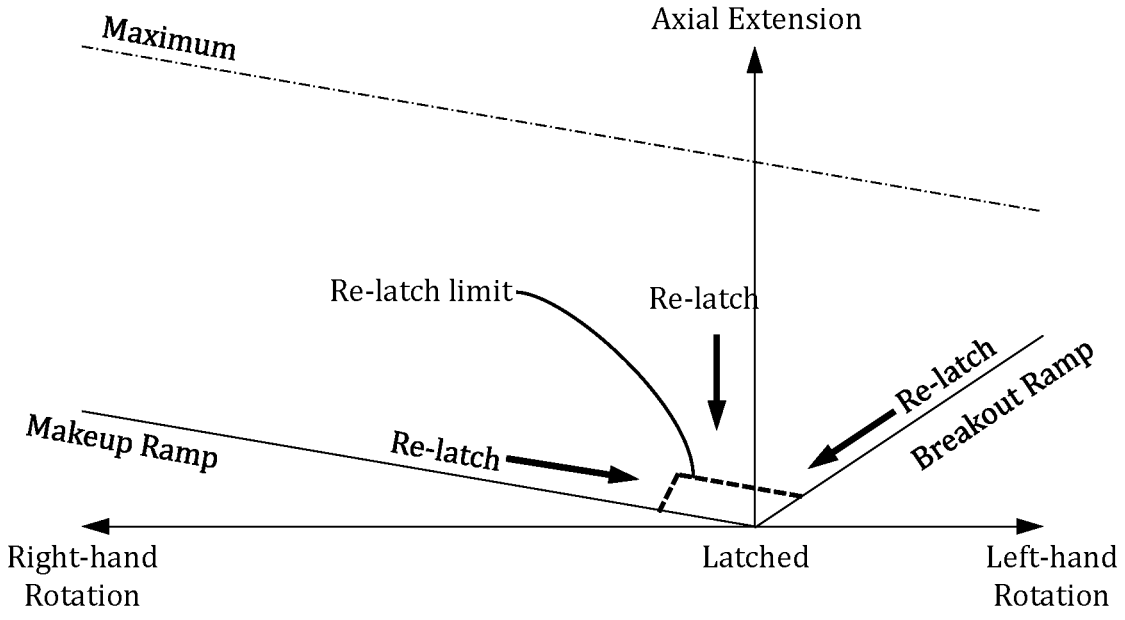
FIG. 4 is a graphical representation of a portion of the operating range of an axial extension linkage in accordance with the present disclosure.

FIG. 4 is a graphical representation of a portion of the operating range of a first embodiment 1300 of an axial extension linkage in accordance with the present disclosure. The makeup ramp line shown in FIG. 4 corresponds to the drive thread lead, and the breakout ramp line corresponds to the driven thread lead, of linkage 1300. In contrast to prior art axial extension linkage 130 that must be re-latched following a specific operational sequence, axial extension linkage 1300 may be re-latched following any operational sequence that ends at the latched position. A few exemplary operational sequences are illustrated by the arrows labeled "Re-latch" in FIG. 4.

Figure 5A:
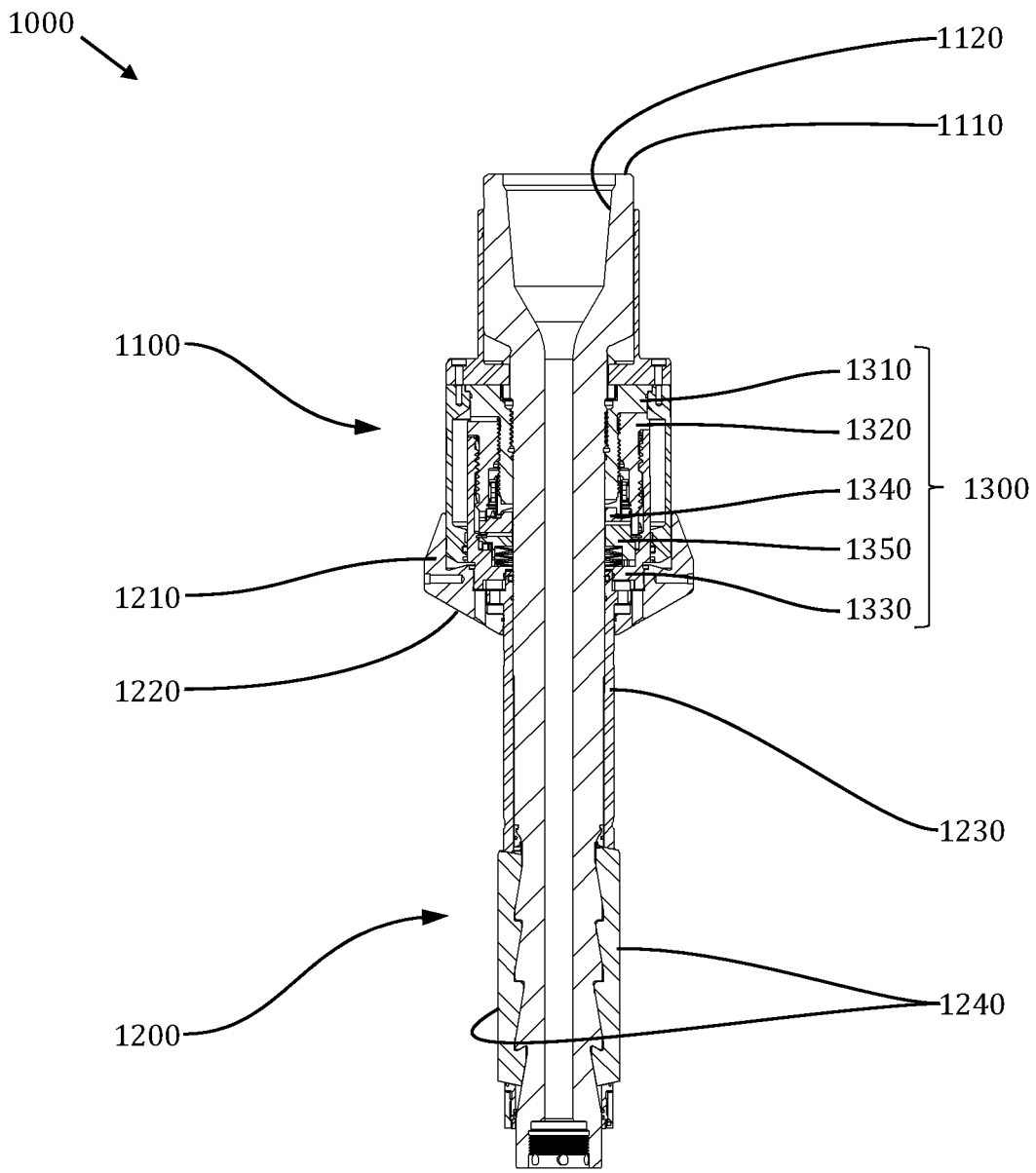
FIG. 5A is a cross-section view of a first embodiment of an axial extension linkage in accordance with the present disclosure installed in a prior art CRTi.

FIG. 5A is a longitudinal cross-section view through axial extension linkage 1300, incorporated into a prior art internally-gripping CRT 1000 which is functionally and operationally similar to CRT 100. CRT 1000 comprises a main body assembly 1100, a gripping assembly 1200, and axial extension linkage 1300. The upper end of main body assembly 1100 is provided with a load adaptor 1110, illustrated by way of non-limiting example as having a conventional tapered-thread connection 1120 for structural connection to a top drive quill (not shown) of a drilling rig (not shown).

Gripping assembly 1200 comprises a land surface 1220 that is carried by a bumper 1210 attached to a cage 1230, and grip surfaces 1240 that are carried by and axially and rotationally linked to cage 1230. CRT 1000 is shown in FIG. 5A as it would appear in the latched position. In this latched position, relative axial movement between main body assembly 1100 and gripping assembly 1200 is prevented by axial extension linkage 1300, such that gripping assembly 1200 is held in its retracted position.

Figure 5B:
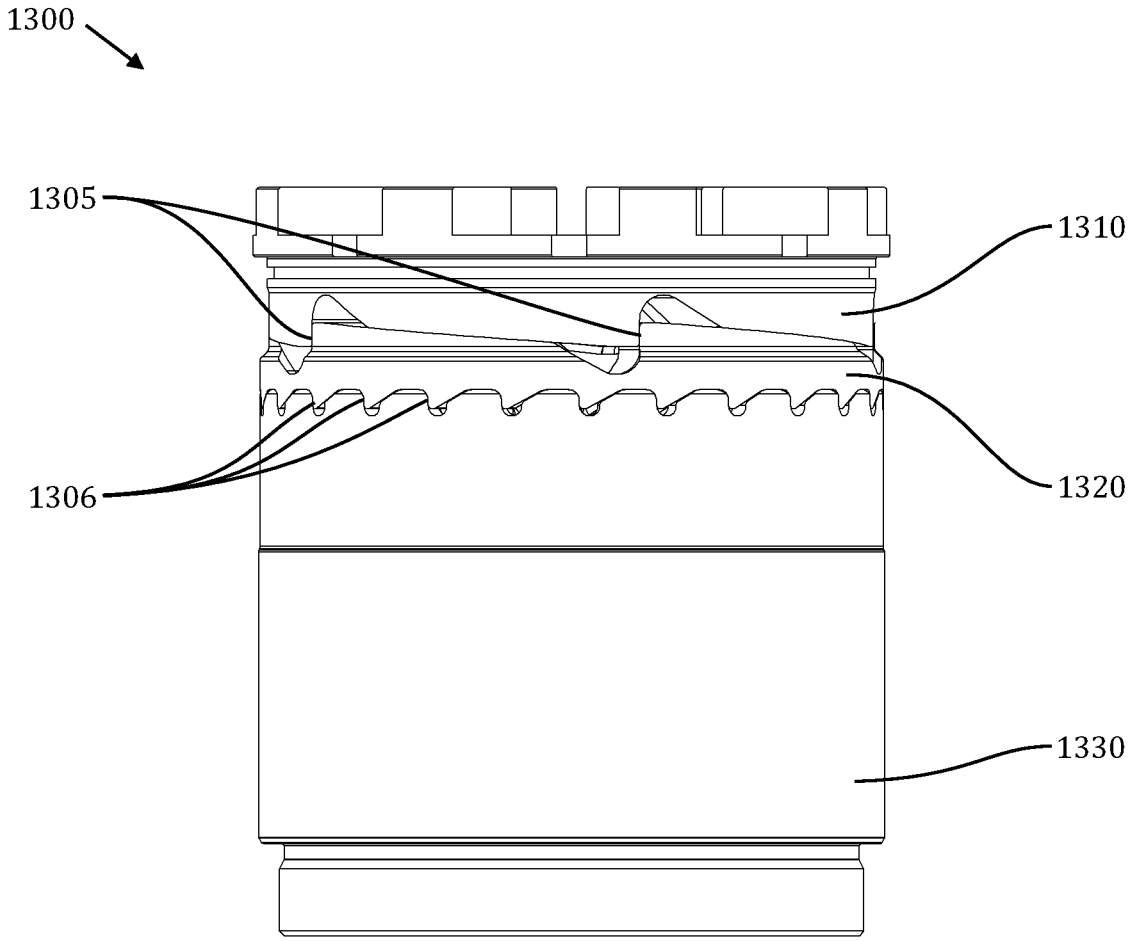
FIGS. 5B and 5C, respectively, are elevation and cross-section views of the axial extension linkage in FIG. 5A, shown in the latched position.
Figure 5C:
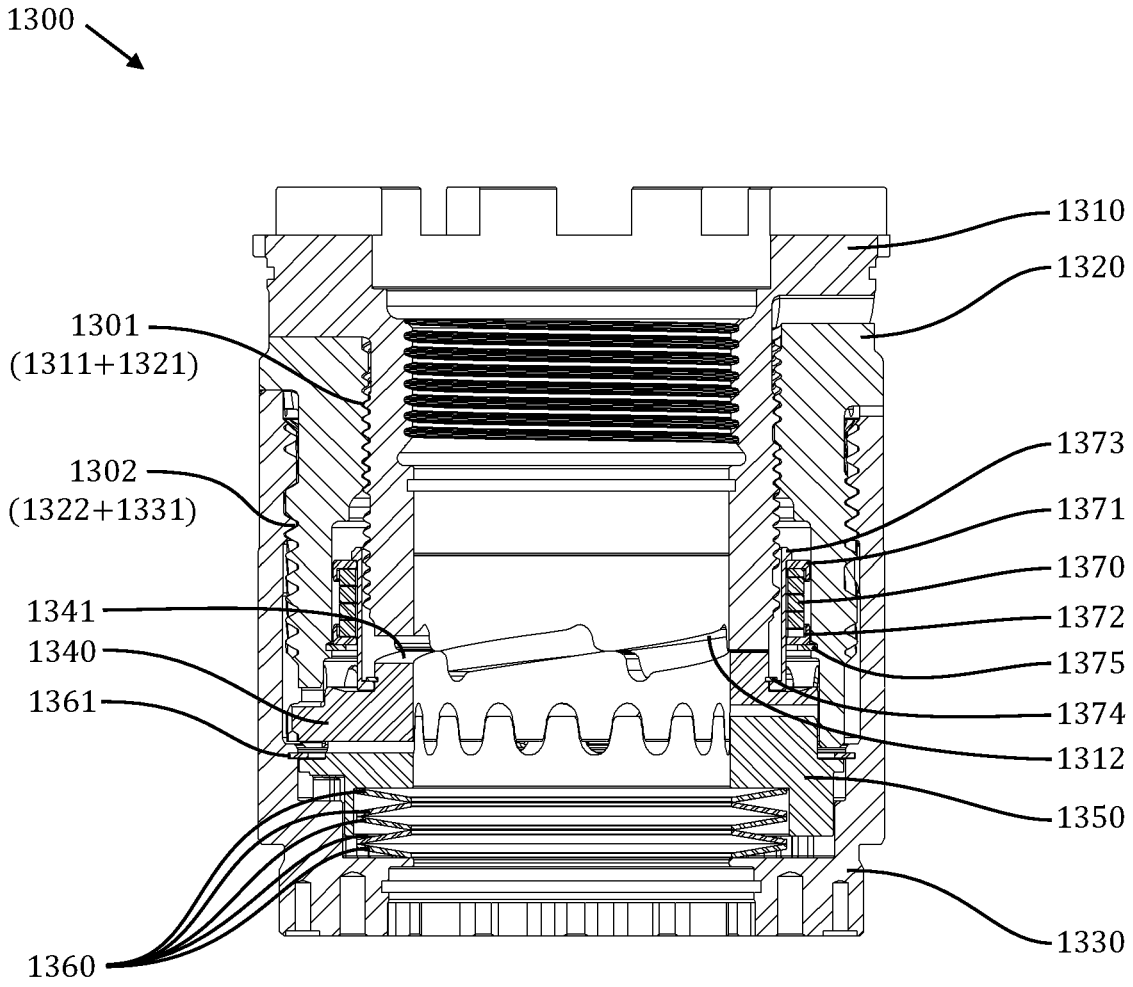

FIGS. 5B and 5C, respectively, are elevation and cross-section views of axial extension linkage 1300, shown in the latched position. In this particular embodiment, axial extension linkage 1300 is configured for installation in CRT 1000 as a replacement for prior art axial extension linkage 130 acting between main body assembly 1100 and gripping assembly 1200.

Figure 5D:
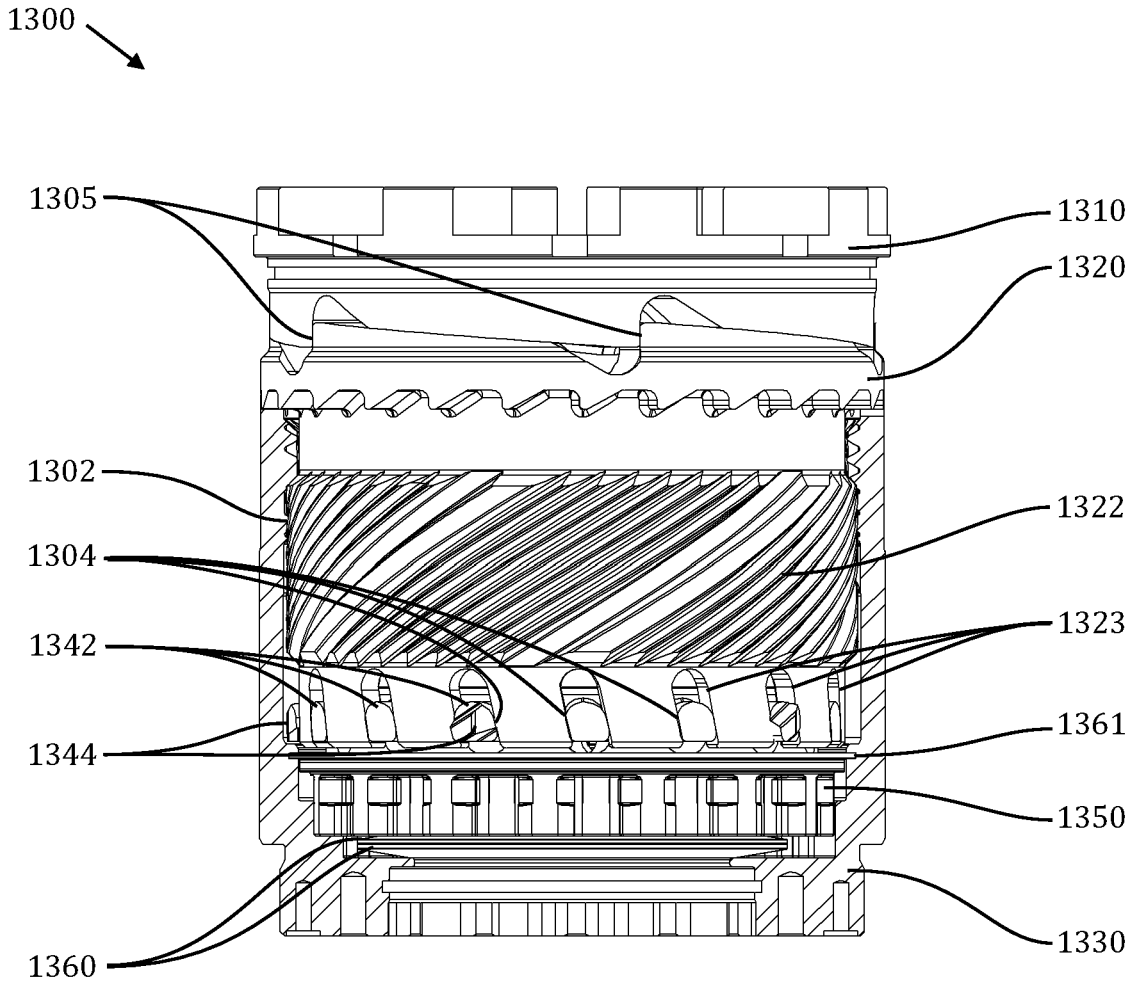
FIG. 5D is a partial cross-section view of the linkage in FIGS. 5B and 5C with only the driven cam body sectioned.
Figure 5E:
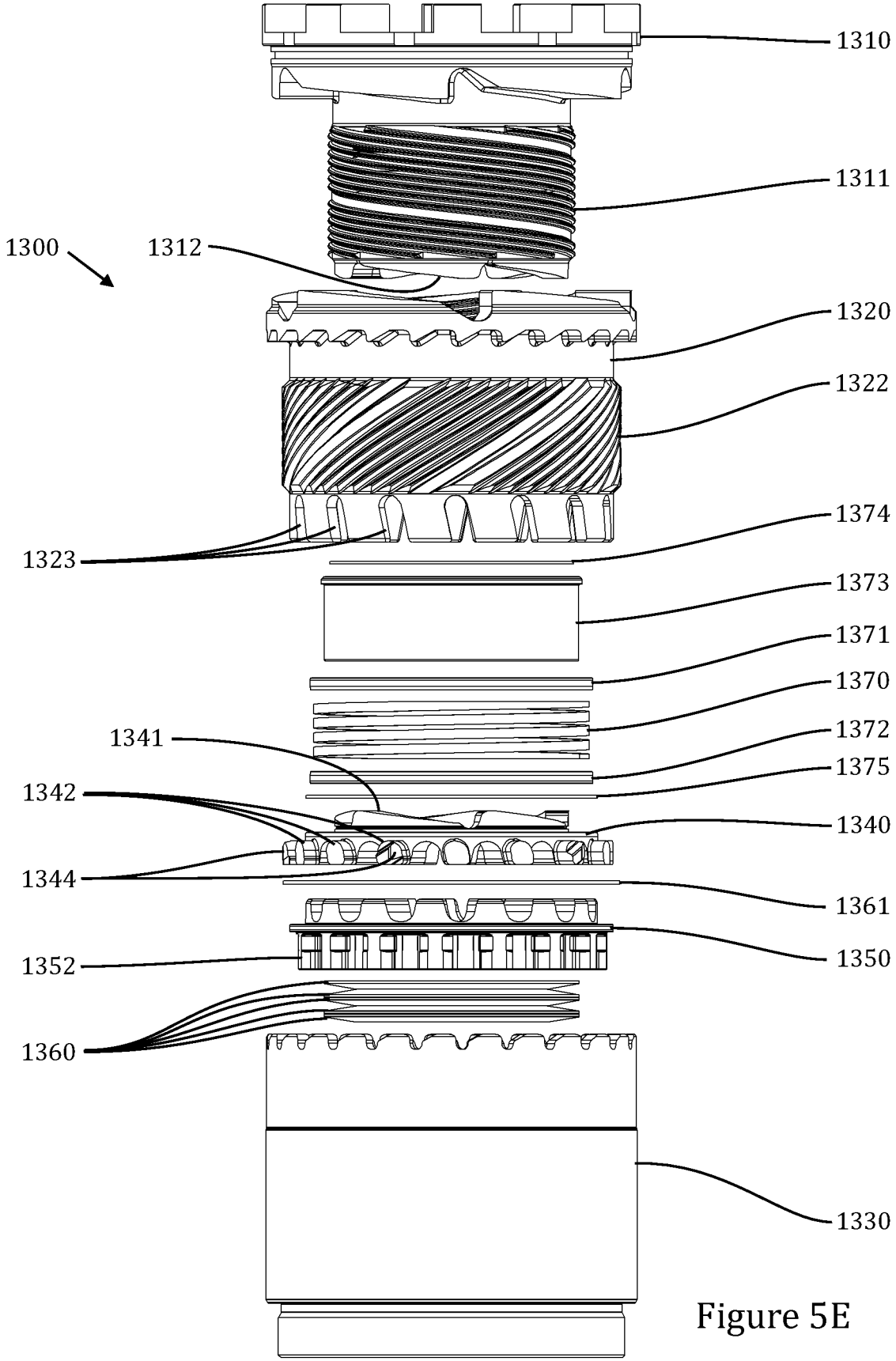
FIGS. 5E, 5F and 5G, respectively, are exploded elevation, longitudinal cross-section, and isometric views of the linkage in FIGS. 5B-5D.
Figure 5F:
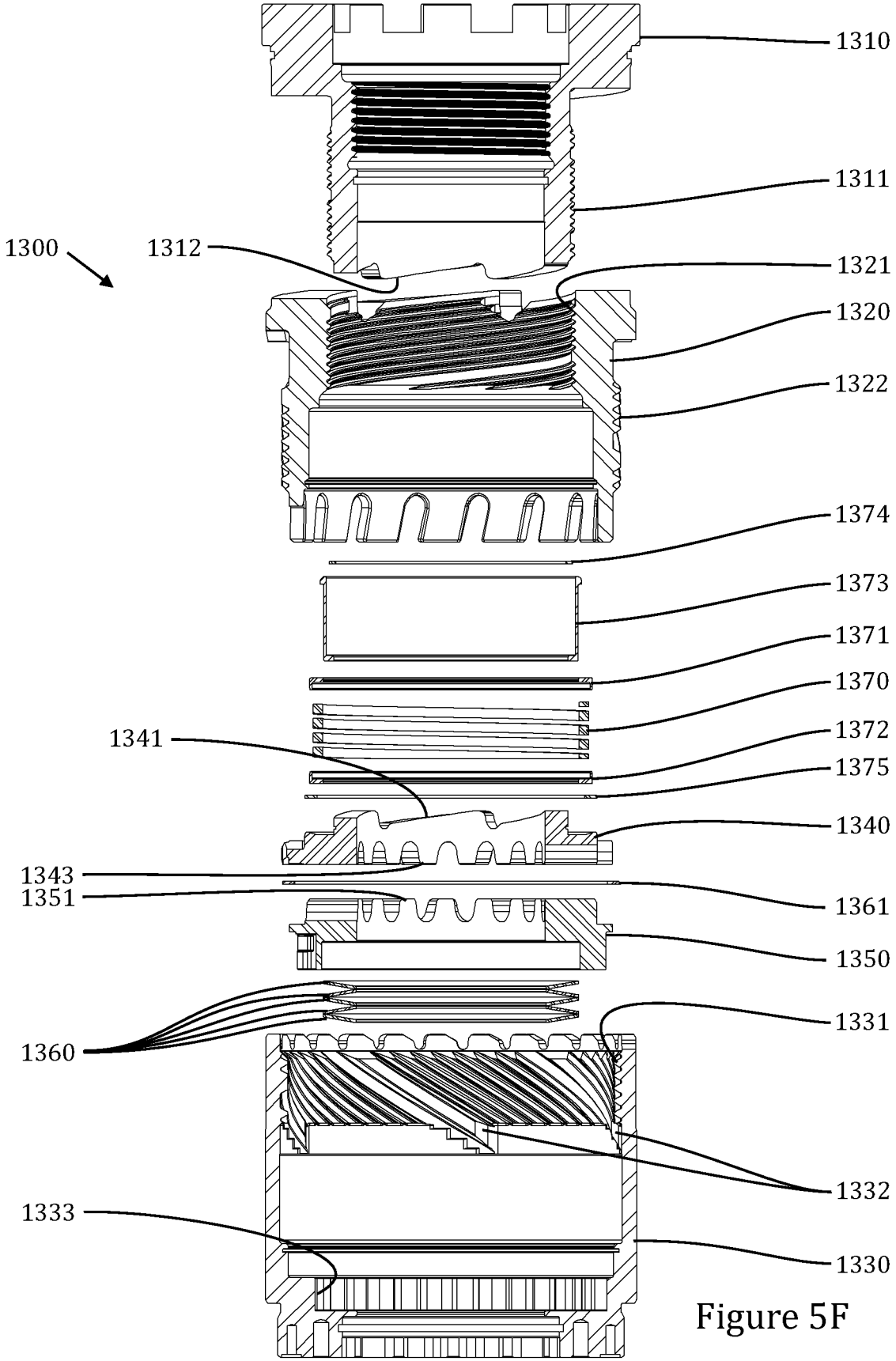
Figure 5G:
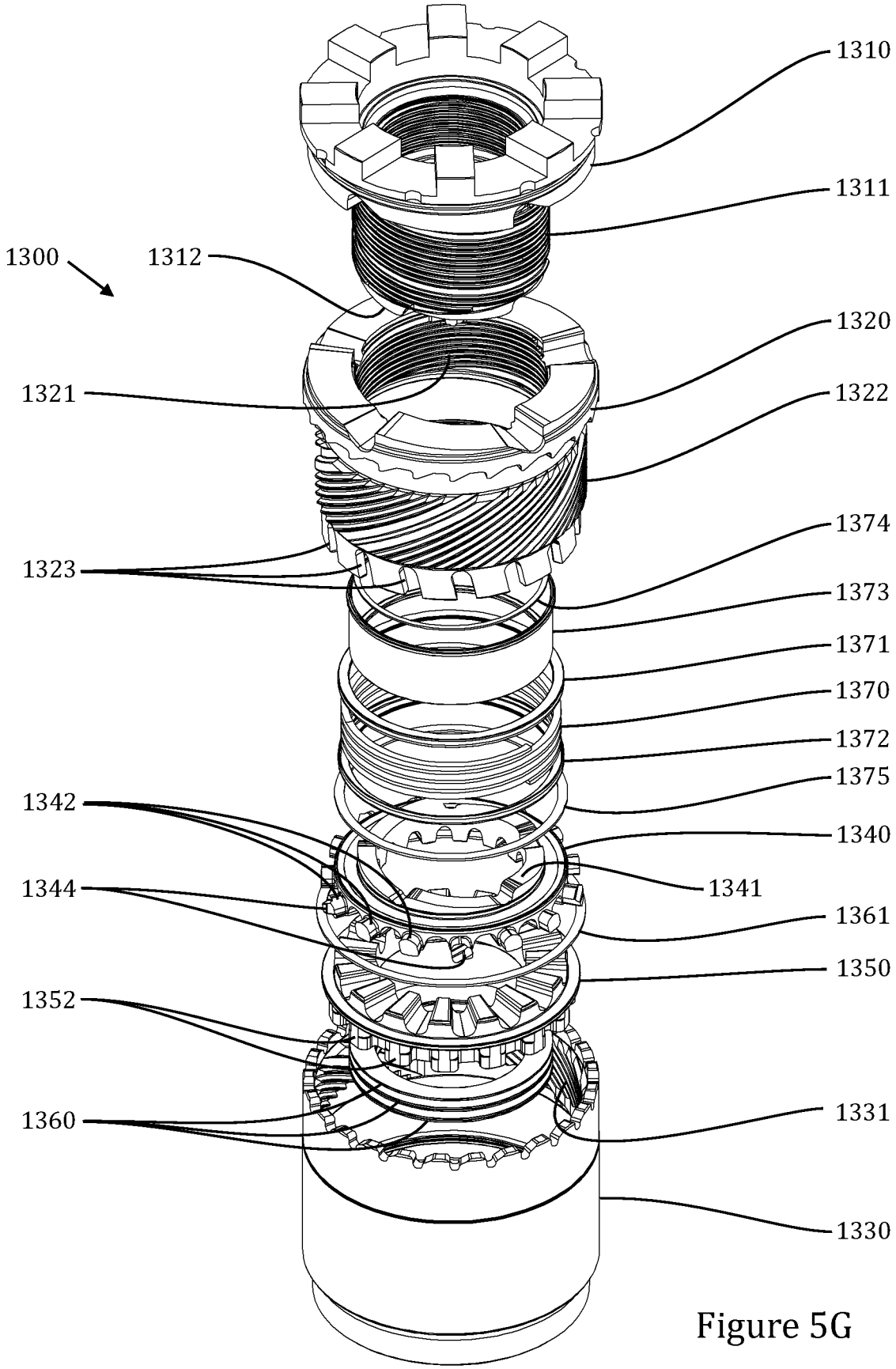

FIGS. 5E, 5F and 5G, respectively, are exploded elevation, cross-section, and isometric views of axial extension linkage 1300. Axial extension linkage 1300 comprises a drive cam body 1310, an intermediate cam body 1320, a driven cam body 1330, a primary drive thread stop 1305, a primary driven thread stop 1306, a latch body 1340, a striker body 1350, a striker retaining clip 1361, a first biasing means comprising a plurality of conical spring washers 1360, a second biasing means comprising a coil spring 1370, an upper end ring 1371, a lower end ring 1372, a sleeve 1373, an inner retaining clip 1374, and an outer retaining clip 1375.

FIG. 5D is a partial cross-section of axial extension linkage 1300 with only driven cam body 1330 sectioned.

Drive cam body 1310 is carried by main body assembly 110 and linked to load adaptor 111 so as to be generally fixed against rotation and axial movement relative to load adaptor 111. Driven cam body 1330 is carried by gripping assembly 1200 and linked to cage 1230 so as to be generally fixed against rotation and axial movement relative to cage 1230. The operational sequence for unlatching axial extension linkage 1300 is the same as the operational sequence for unlatching prior art axial extension linkage 130: i.e., right-hand rotation of main body assembly 1100 relative to gripping assembly 1200 will move axial extension linkage 1300 (and thus CRT 1000) to an unlatched position, as will be described in detail later in this disclosure.

Drive cam body 1310 and intermediate cam body 1320 are threadingly engaged via a drive thread 1301 comprising an external multi-start thread 1311 on drive cam body 1310 engaging an internal multi-start thread 1321 on intermediate cam body 1320. Drive thread 1301 acts to translate right-hand rotation of drive cam body 1310 relative to intermediate cam body 1320 into axial extension of axial extension linkage 1300. Intermediate cam body 1320 and driven cam body 1330 are threadingly engaged via a driven thread 1302 comprising an external multi-start thread 1322 on intermediate cam body 1320 engaging an internal multi-start thread 1331 on driven cam body 1330 and acting in opposition to drive thread 1301. Driven thread 1302 acts to translate left-hand rotation of intermediate cam body 1320 relative to driven cam body 1330 into axial extension of axial extension linkage 1300.

The lead angles of drive thread 1301 and driven thread 1302 are selected such that axial load transmitted through linkage 1300 will cause intermediate cam body 1320 to rotate and thereby cause the length of linkage 1300 to change.

Primary drive thread stop 1305 acts between drive cam body 1310 and intermediate cam body 1320 to limit the range of travel of drive thread 1301 when drive cam body 1310 is rotated in the left-hand direction relative to intermediate cam body 1320. Primary driven thread stop 1306 acts between intermediate cam body 1320 and driven cam body 1330 to limit the range of travel of driven thread 1302 when intermediate cam body 1320 is rotated in the right-hand direction relative to driven cam body 1330. Both primary drive thread stop 1305 and primary driven thread stop 1306 are configured to be non-jamming.

Latch body 1340 is carried by intermediate cam body 1320 and is axially slidingly movable relative to intermediate cam body 1320 between a first (or "latching") position and a second (or "free") position. Drive cam body 1310 has an axially-downward-facing cam surface 1312 that is contactingly and slidingly engageable with an axially-upward-facing cam surface 1341 on latch body 1340. As best seen in FIG. 5D, a plurality of pins 1342 on latch body 1340 engage a plurality of slots 1323 on intermediate cam body 1320 to guide the movement of latch body 1340 on intermediate cam body 1320 between its latching and free positions.

When drive cam body 1310 is rotated to a latching position relative to intermediate cam body 1320, cam surfaces 1312 and 1341 act to move and positively hold latch body 1340 in its latching position on intermediate cam body 1320. When latch body 1340 is in its latching position, it may engage striker body 1350.

When drive cam body 1310 is not in its latching position relative to intermediate cam body 1320, cam surfaces 1312 and 1341 permit latch body 1340 to move to its free position on intermediate cam body 1320. Coil spring 1370 urges latch body 1340 toward its free position on intermediate cam body 1320. When latch body 1340 is in its free position on intermediate cam body 1320, latch body 1340 cannot engage striker body 1350.

Coil spring 1370 is compressed when assembled within axial extension linkage 1300. The upper end of coil spring 1370 is connected to latch body 1340 via upper end ring 1371, sleeve 1373 and inner retaining clip 1374. The lower end of coil spring 1370 is connected to intermediate cam body 1320 by lower end ring 1372 and outer retaining clip 1375.

Striker body 1350 is carried by driven cam body 1330 and is axially slidingly movable relative to driven cam body 1330 within defined limits. An externally-splined surface 1352 on striker body 1350 engages an internally-splined surface 1333 on driven cam body 1330, preventing relative rotation between these two bodies. Conical spring washers 1360 urge striker body 1350 toward a "latching" position and engagement with latch body 1340. Striker body 1350 is axially retained and constrained within driven cam body 1330 by striker retaining clip 1361.

Latch body 1340 is configured with a latch surface 1343 for mating engagement with a latch surface 1351 on striker body 1350. Mating engagement occurs when latch body 1340 is in its latching position, striker body 1350 is in its latching position, and driven thread 1302 is axially positioned at the limit of its operating range, as defined by abutting engagement with primary driven thread stop 1306. When latch body 1340 and striker body 1350 are in mating engagement, latch body 1340 and striker body 1350 will resist movement of driven thread 1302 (i.e., they will resist relative rotation between intermediate cam body 1320 and driven cam body 1330). The geometries of driven thread 1302, the sliding of striker body 1350 on driven cam body 1330, and mating latch surfaces 1343 and 1351 on latch body 1340 and striker body 1350, respectively, and the force of the conical spring washer 1360 urging engagement of striker body 1350 to latch body 1340, may be selected such that latch body 1340 and striker body 1350 either will disengage at selected combinations of axial load and torque applied to axial extension linkage 1300, or will not tend to disengage.

Axial extension linkage 1300 is considered to be "latched" and in its "latched position" when:

- latch body 1340 is matingly engaged with striker body 1350, which requires that:
  - latch body 1340 is in its latching position;
  - striker body 1350 is in its latching position; and
  - driven thread 1302 is axially positioned at the limit of its operating range, as defined by abutting engagement with primary driven thread stop 1306; and
- drive cam body 1310 is in its latching position, holding latch body 1340 in its latching position.

Axial extension linkage 1300 is considered to be "unlatched" and in an "unlatched position" when any one of the above conditions is not met.

When axial extension linkage 1300 is unlatched and axially extended such that latch body 1340 cannot engage striker body 1350, drive thread 1301 and driven thread 1302 will translate bi-directional rotation of load adaptor 1110 in either the clockwise direction or the counter-clockwise direction, respectively (relative to grip surface 1240), into axial elongation (i.e., extension) of axial extension linkage 1300 to drive axial-stroke activation of gripping assembly 1200.

Axial extension linkage 1300 further comprises a secondary driven thread stop, provided by shoulder surfaces 1344 formed on the ends of a selected plurality of pins 1342 of latch body 1340 and configured for abutting contact with a corresponding plurality of shoulder surfaces 1332 on driven cam body 1330, and thus limit the operating range of driven thread 1302 when latch body 1340 is in its free position.

The following sections of this disclosure describe the typical operation of exemplary embodiments of axial extension linkages in accordance with the present disclosure.

FIGS. 6A, 6B, 7A, 7B, 8A, 8B, 9A, 9B, 10A, 10B, 11A, 11B, 12A, and 12B are schematic elevation and isometric views of an exemplary embodiment 2300 of an axial extension linkage in accordance with the present disclosure, shown in several operational positions analogous to operational positions of axial extension linkage 1300 as will be described below.

To facilitate a clear understanding of the structure and operation of the axial extension linkage, FIGS. 6A to 12B illustrate a representative operative portion of an axial extension linkage 2300 in accordance with the present disclosure, but in planar projection, schematically depicting the generally cylindrical linkage in two-dimensional form (similar to the way that a Mercator projection illustrates the curved surface of the earth in two-dimensional form). Although FIGS. 6A to 12B thus are primarily intended to illustrate and explain a three-dimensional embodiment, it should be noted that this disclosure also contemplates actual planar embodiments for use in non-rotary applications unrelated to the primary context in which the axial extension linkage is described herein (i.e., running tubular strings into petroleum wells).

In FIGS. 6A to 12B, movement of axial extension linkage 2300 toward the top or bottom of these schematic views is analogous to axial movement of axial extension linkage 1300, and movement of linkage 2300 toward the left or right of these schematic views (i.e., transverse movement) is analogous to rotary movement of axial extension linkage 1300.

Axial extension linkage 2300 comprises a drive cam body 2310, an intermediate cam body 2320, a driven cam body 2330, a primary drive thread stop 2305, a primary driven thread stop 2306, a latch body 2340, a striker body 2350, a first biasing means 2360, and a second biasing means 2370. Latch body 2340 is carried by intermediate cam body 2320, and is slidingly movable relative to intermediate cam body 2320 between a first (or "latching") position and a second (or "free") position. Striker body 2350 is carried by driven cam body 2330, and is constrained to move relative to driven cam body 2330 within defined limits. First biasing means 2360 acts between striker body 2350 and driven cam body 2330 so as to urge striker body 2350 toward a "latching" position and engagement with latch body 2340.

Drive cam body 2310 and intermediate cam body 2320 are engaged via a drive pin-slot mechanism 2301 that exemplifies a threaded engagement of these two bodies. Drive pin-slot mechanism 2301 acts to translate leftward motion of drive cam body 2310 relative to intermediate cam body 2320 into axial extension of axial extension linkage 2300. Intermediate cam body 2320 and driven cam body 2330 are engaged via a driven pin-slot mechanism 2302, which exemplifies a threaded engagement of these two bodies, and acts in opposition to drive pin-slot mechanism 2301. Driven pin-slot mechanism 2302 acts to translate rightward motion of intermediate cam body 2320 relative to driven cam body 2330 into axial extension of axial extension linkage 2300. Leftward and rightward ("transverse") movements of drive cam body 2310 relative to driven cam body 2330 are analogous to relative rotary movements of axial extension linkages in accordance with the present disclosure, and these transverse movements are translated into axial extension of linkage 2300 by drive pin-slot mechanism 2301 and driven pin-slot mechanism 2302.

The angles of pin-slot mechanisms 2301 and 2302 exemplify the lead angles of threaded engagement and are selected such that axial load transmitted through linkage 2300 will cause transverse movement of intermediate cam body 2320 and a consequent change to the axial length of linkage 2300.

Primary drive thread stop 2305 acts between drive cam body 2310 and intermediate cam body 2320 to limit the range of travel of drive pin-slot mechanism 2301 when drive cam body 2310 moves rightwards relative to intermediate cam body 2320. Primary driven thread stop 2306 acts between intermediate cam body 2320 and driven cam body 2330 to limit the range of travel of driven pin-slot mechanism 2302 when intermediate cam body 2320 moves leftwards relative to driven cam body 2330. Both primary drive thread stop 2305 and primary driven thread stop 2306 are configured to be non-jamming.

Drive cam body 2310 has a cam surface 2312 that is contactingly and slidingly engageable with a cam surface 2341 on latch body 2340. A third pin-slot mechanism 2304 guides the movement of latch body 2340 on intermediate cam body 2320 between its latching and free positions. When drive cam body 2310 is moved to a "latching" position relative to intermediate cam body 2320, cam surfaces 2312 and 2341 contact and act to move, and then positively hold, latch body 2340 in its latching position on intermediate cam body 2320 following a path defined by third pin-slot mechanism 2304. When latch body 2340 is in its latching position on intermediate cam body 2320, it may engage striker body 2350.

When drive cam body 2310 is not in its latching position relative to intermediate cam body 2320, cam surfaces 2312 and 2341 permit latch body 2340 to move to its free position on intermediate cam body 2320 following a path defined by third pin-slot mechanism 2304. Second biasing means 2370 urges latch body 2340 toward its free position on intermediate cam body 2320. When latch body 2340 is in its free position on intermediate cam body 2320, latch body 2340 cannot engage striker body 2350.

Movement of striker body 2350 relative to driven cam body 2330 is limited by the inclined parallel side surfaces on striker body 2350 sliding against the inclined parallel guide surfaces on driven cam body 2330. The helix angle associated with this sliding movement may be selected to be zero, such as with spline surfaces 1352 and 1333 of axial extension linkage 1300. (Helix angle is defined as the angle between a helix and a line parallel to the axis of the helix.)

Latch body 2340 is configured with a latch surface 2343 for mating engagement with a latch surface 2351 on striker body 2350. Mating engagement occurs when latch body 2340 is in its latching position, striker body 2350 is in its latching position, and driven pin-slot mechanism 2302 is axially positioned at the limit of its operating range defined by engagement of primary driven thread stop 2306. Striker body 2350 is urged toward its latching position and engagement with latch body 2340 by first biasing means 2360. When latch body 2340 and striker body 2350 are in mating engagement, latch body 2340 and striker body 2350 will resist movement of driven pin-slot mechanism 2302 (i.e., they will resist relative movement between intermediate cam body 2320 and driven cam body 2330).

The geometries of driven pin-slot mechanism 2302, of the sliding of striker body 2350 on driven cam body 2330, and of mating latch surfaces 2343 and 2351 on latch body 2340 and striker body 2350, respectively, and the force of first biasing means 2370 urging engagement of striker body 2350 to latch body 2340, may be selected such that latch body 2340 and striker body 2350 either will disengage at selected combinations of axial load and torque applied to axial extension linkage 2300 or will not tend to disengage.

Axial extension linkage 2300 is considered to be "latched" and in its "latched position" when:

- latch body 2340 is matingly engaged with striker body 2350, which requires that:
  - latch body 2340 is in its latching position;
  - striker body 2350 is in its latching position; and
  - driven pin-slot mechanism 2302 is axially positioned at the limit of its operating range defined by abutting engagement with primary driven thread stop 2306; and
- drive cam body 2310 is in its latching position, holding latch body 2340 in its latching position.

Axial extension linkage 2300 is considered to be "unlatched" and in an "unlatched position" when any one of the above conditions is not met.

Axial extension linkage 2300 further comprises a secondary driven thread stop, wherein a shoulder surface 2344 on latch body 2340 and a shoulder surface 2332 on driven cam body 2330 are configured to contact and limit the operating range of driven pin-slot mechanism 2302 when latch body 2340 is in its free position.

Figure 6A:
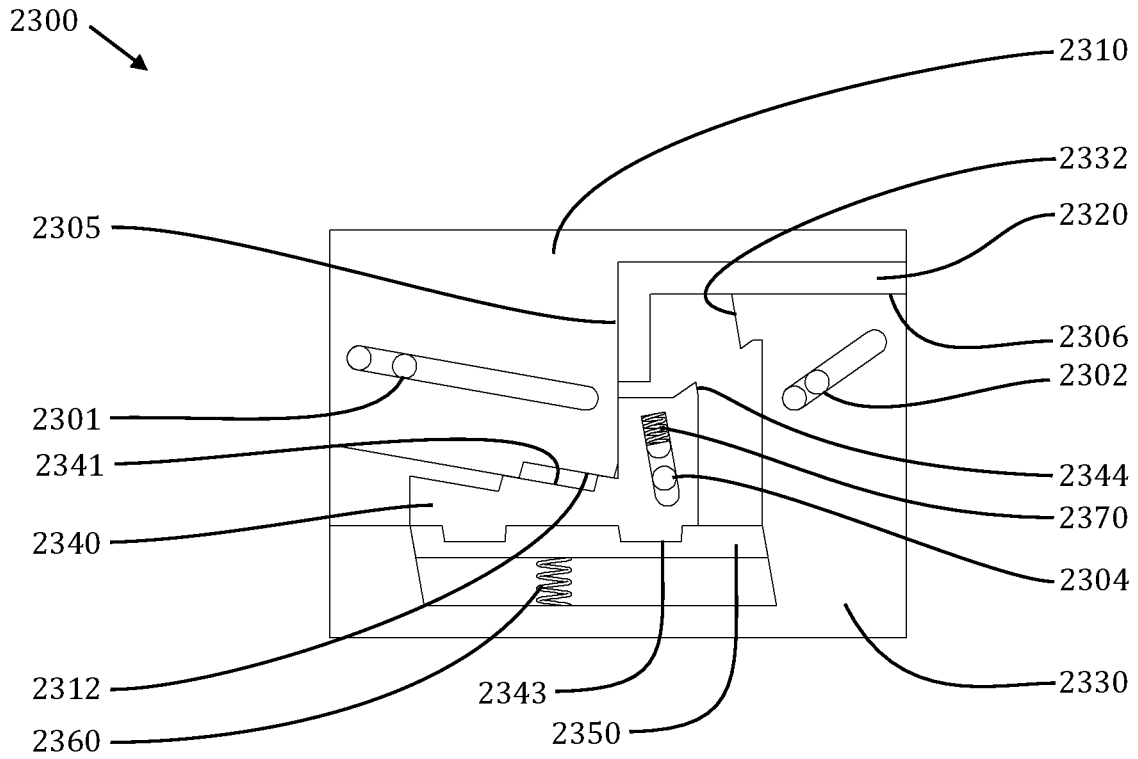
FIGS. 6A and 6B, respectively, are schematic elevation and isometric planar projection views of an exemplary embodiment of an axial extension linkage in accordance with the present disclosure, shown in the latched position.
Figure 6B:
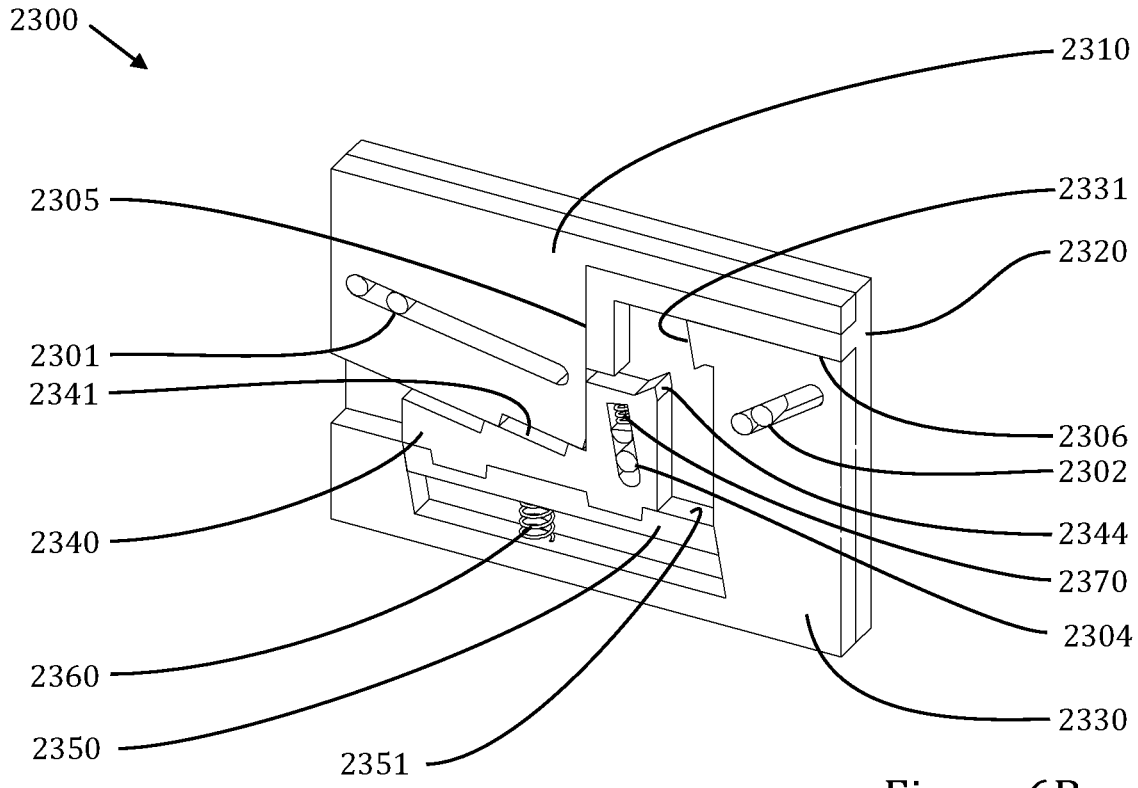

FIGS. 6A and 6B show axial extension linkage 2300 in its latched position. Drive cam body 2310 is in its "latching" position relative to intermediate cam body 2320. Drive cam body 2310 holds latch body 2340 in its latching position by contact of cam surfaces 2312 and 2341. Striker body 2350 is in its latching position and driven pin-slot mechanism 2302 is axially positioned at the limit of its operating range defined by engagement of primary driven thread stop 2306. Latch body 2340 and striker body 2350 are engaged and resist relative movement between intermediate cam body 2320 and driven cam body 2330 along the path defined by driven pin-slot mechanism 2302.

Figure 7A:
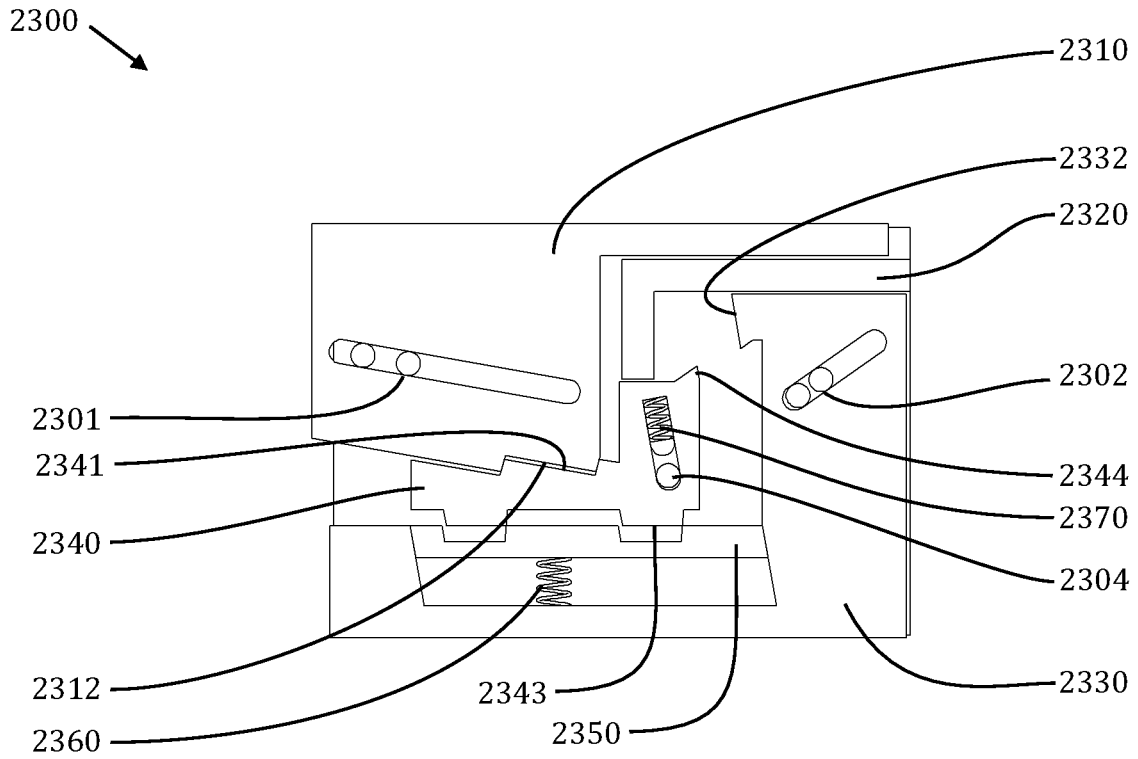
FIGS. 7A and 7B, respectively, are schematic elevation and isometric planar projection views of the linkage in FIGS. 6A and 6B, shown after application of rotation in a first direction of the drive cam body relative to the driven cam body to unlatch the linkage.
Figure 7B:
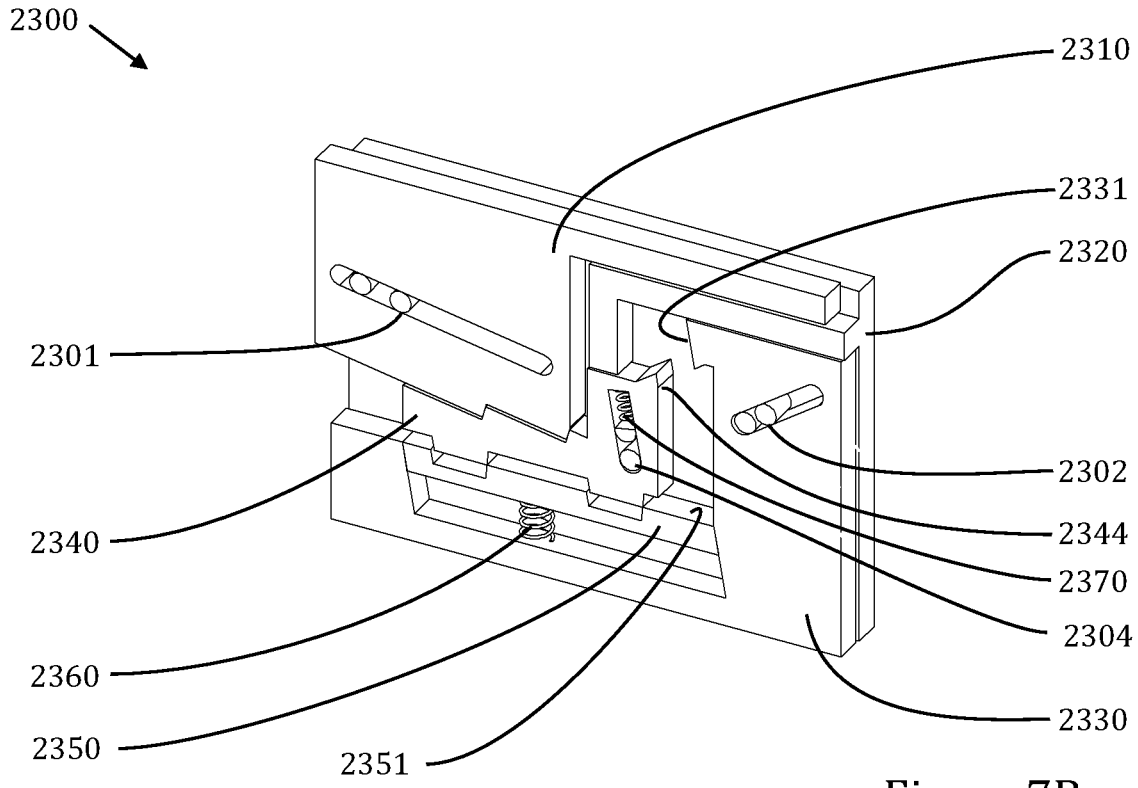

Axial extension linkage 2300 is unlatched by leftward movement of drive cam body 2310 relative to driven cam body 2330 along the path defined by drive pin-slot mechanism 2301 (as shown by FIGS. 7A and 7B), which allows latch body 2340 to move upward to its free position as urged by second biasing means 2370. Latch body 2340 in its free position cannot engage striker body 2350, and intermediate cam body 2320, which carries striker body 2350, may then move relative to driven cam body 2330 along the path defined by driven pin-slot mechanism 2302.

When linkage 2300 is unlatched, axial extension can occur without transverse movement of drive cam body 2310 relative to driven cam body 2330 by simultaneous motion of drive pin-slot mechanism 2301 and driven pin-slot mechanism 2302, as can been seen by comparing FIGS. 8A and 8B to FIGS. 7A and 7B. During normal operation of an axial extension linkage installed in CRT 1000, axial extension is limited by CRT 1000 when grip surfaces 1240 of gripping assembly 1200 contact a workpiece. In abnormal operation (such as when an axial extension linkage is unlatched and no workpiece is present), axial extension of exemplary embodiment 2300 is limited by contact of shoulder surface 2344 on latch body 2340 and shoulder surface 2332 on driven cam body 2330, as shown in FIGS. 9A and 9B.

Relative to FIGS. 8A and 8B, FIGS. 10A and 10B show leftward movement of drive cam body 2310 relative to driven cam body 2330 with no change in axial extension. Drive cam body 2310 moves relative to intermediate cam body 2320 along the path defined by drive pin-slot mechanism 2301, and intermediate cam body 2320 simultaneously moves relative to driven cam body 2330 along the path defined by driven pin-slot mechanism 2302. At the operational position shown in FIGS. 10A and 10B, primary drive thread stop 2306 between intermediate cam body 2320 and driven cam body 2330 has been engaged, and any further leftward movement of drive cam body 2310 relative to driven cam body 2330 would be translated into further axial extension and thus increased radial gripping force between grip surfaces 1240 and a workpiece.

Figure 8A:
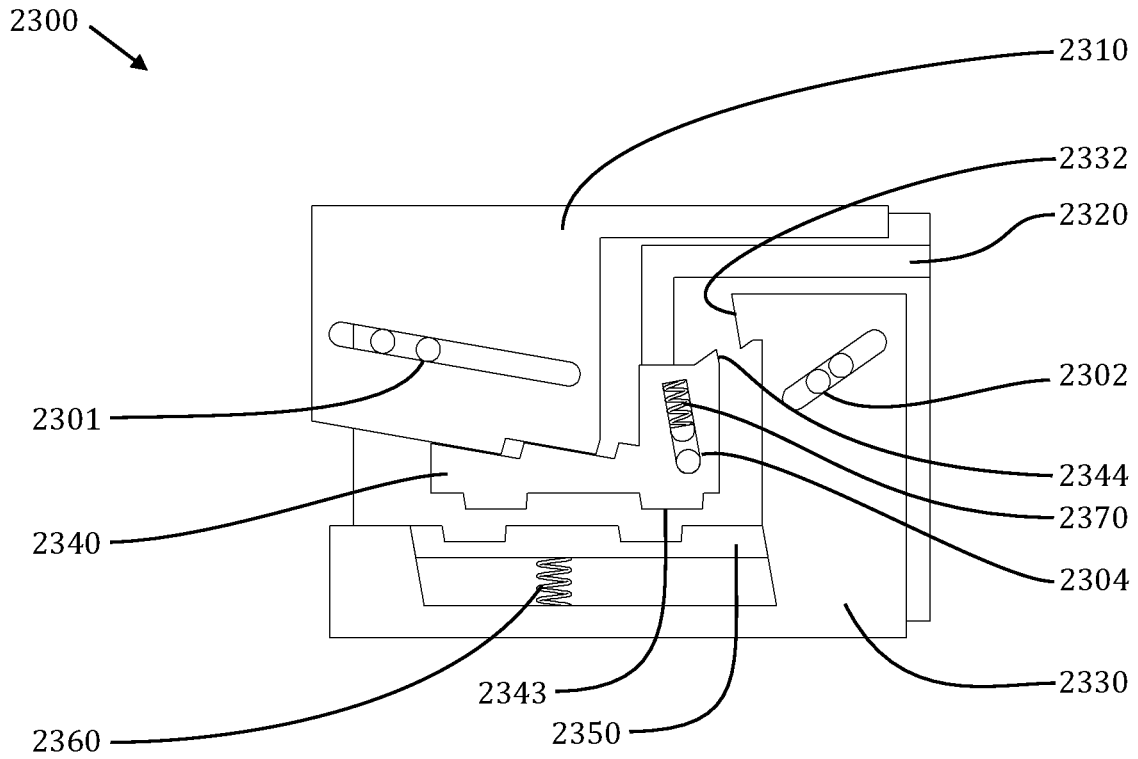
FIGS. 8A and 8B, respectively, are schematic elevation and isometric planar projection views of the unlatched linkage in FIGS. 7A and 7B, shown after application of axial tensile load causing partial axial extension of the drive cam body relative to the driven cam body.
Figure 8B:
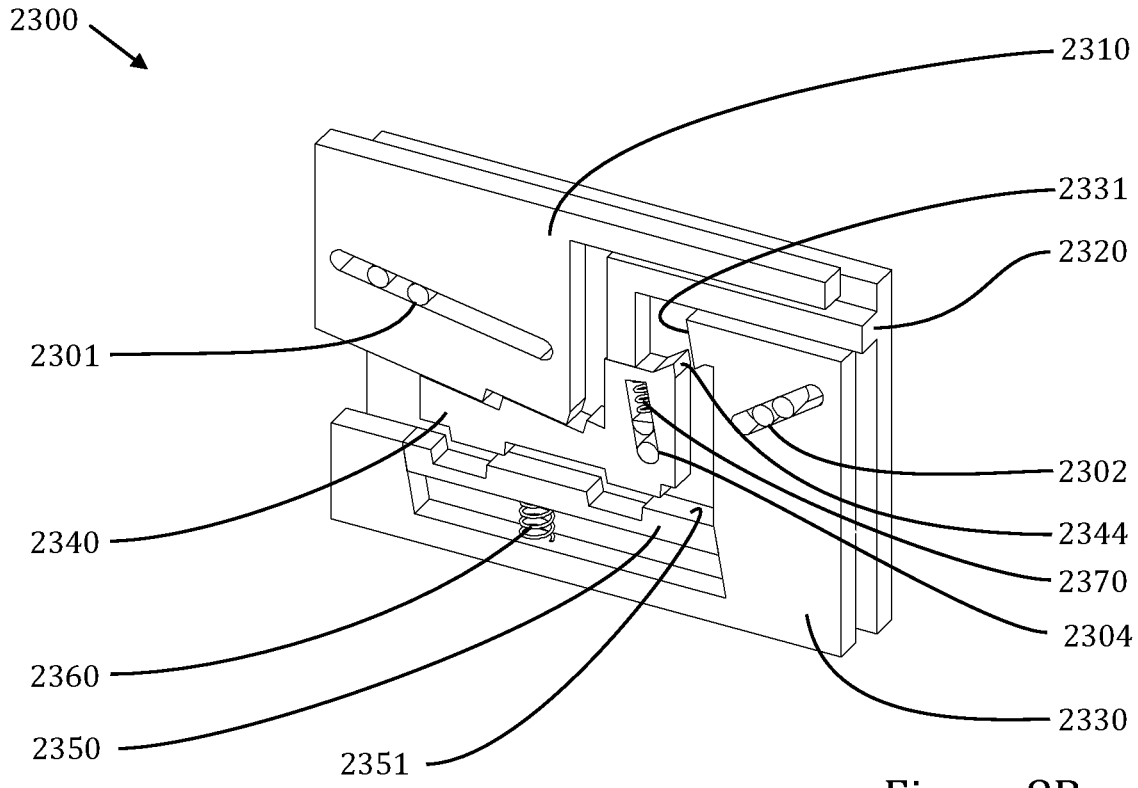
Figure 9A:
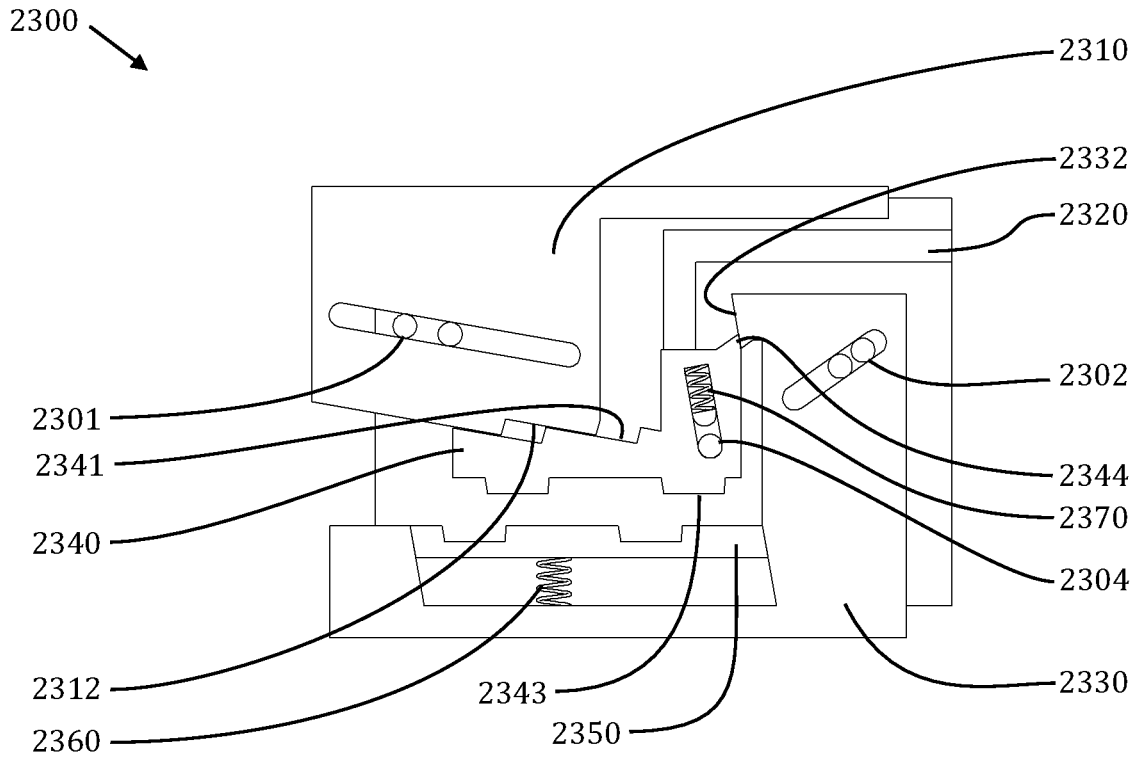
FIGS. 9A and 9B, respectively, are schematic elevation and isometric planar projection views of the unlatched linkage in FIGS. 8A and 8B, shown after further axial extension of the drive cam body relative to the driven cam body to engage a secondary driven thread stop.
Figure 9B:
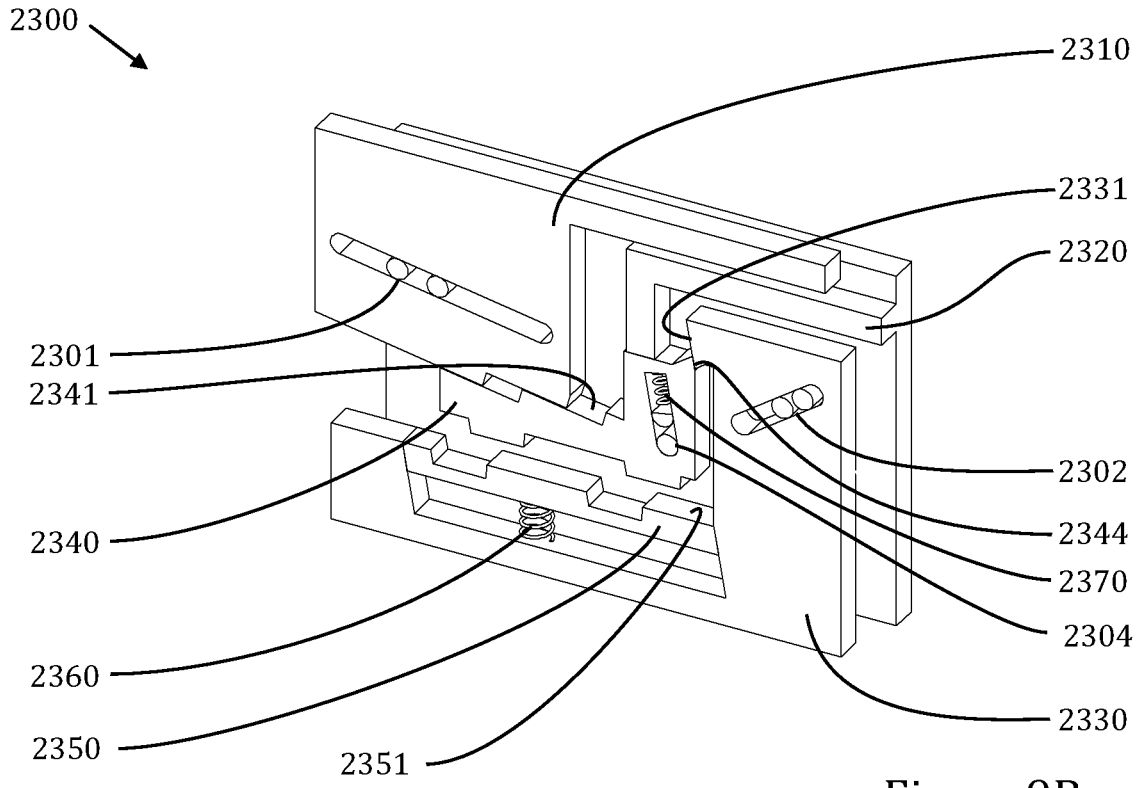
Figure 10A:
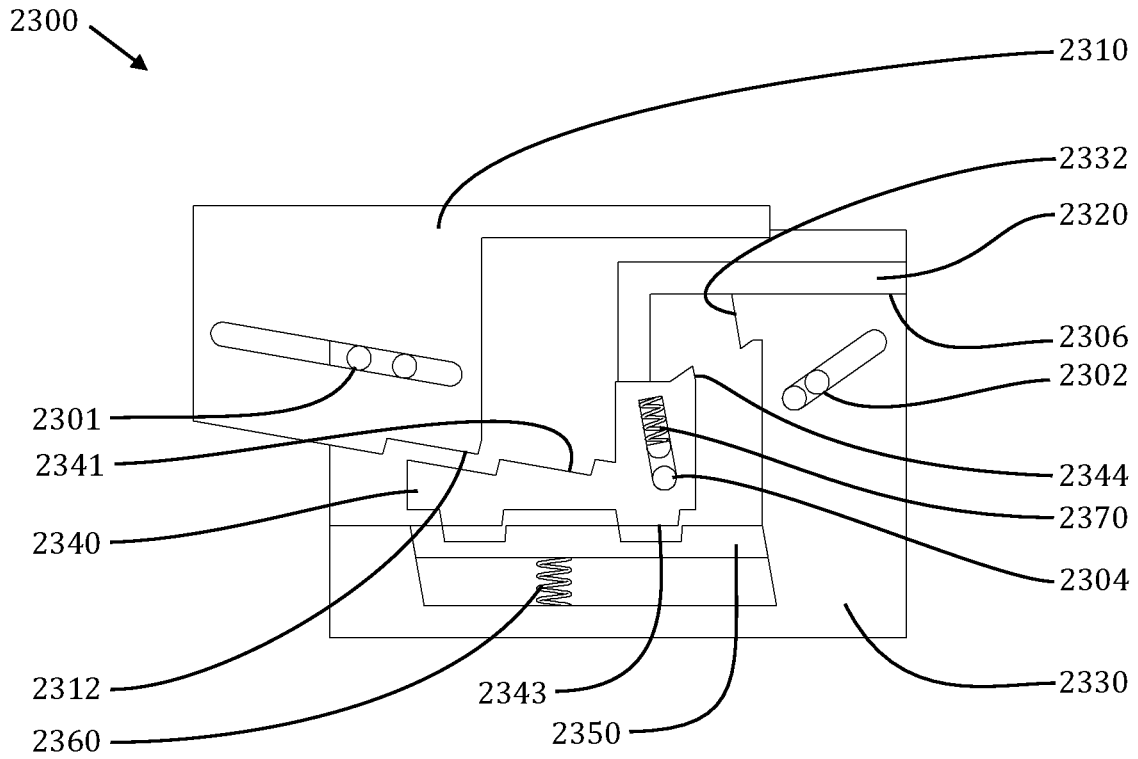
FIGS. 10A and 10B, respectively, are schematic elevation and isometric planar projection views of the unlatched and partially axially-extended linkage in FIGS. 8A and 8B, shown after further rotation of the drive cam body in the first direction, relative to the driven cam body, to a first threshold position from which further rotation in the first direction will cause further extension of the linkage.
Figure 10B:
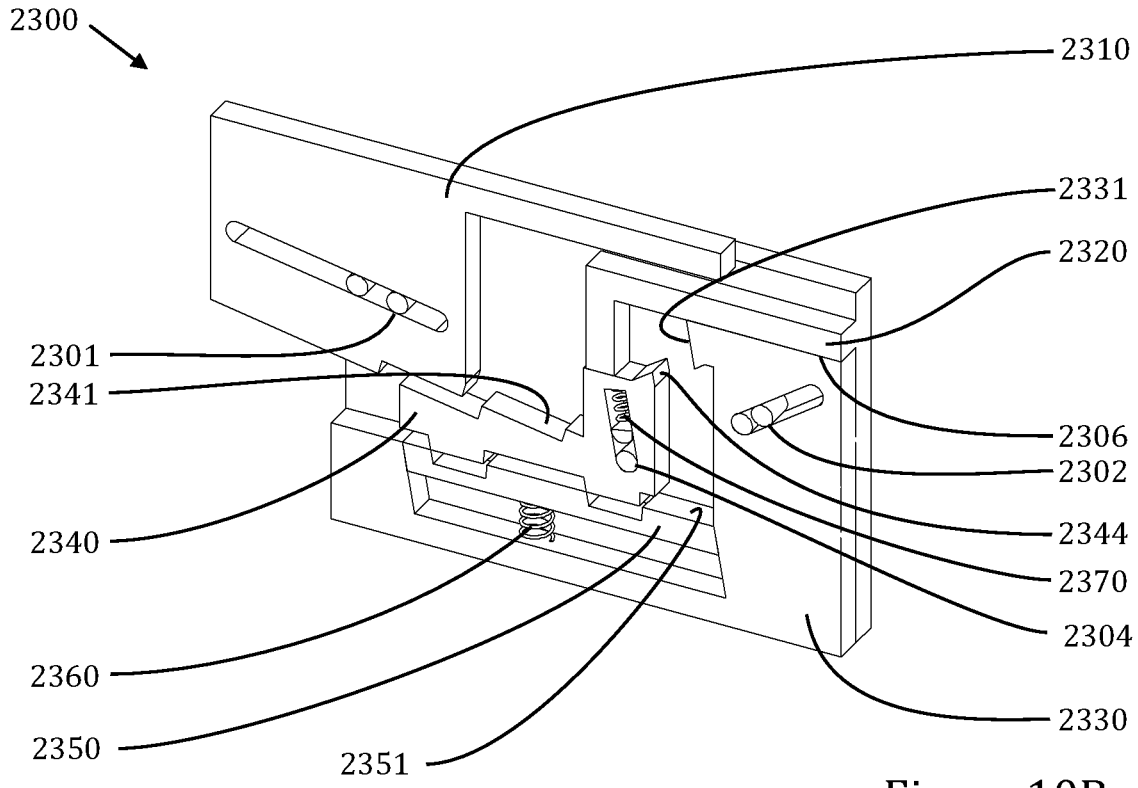
Figure 11A:
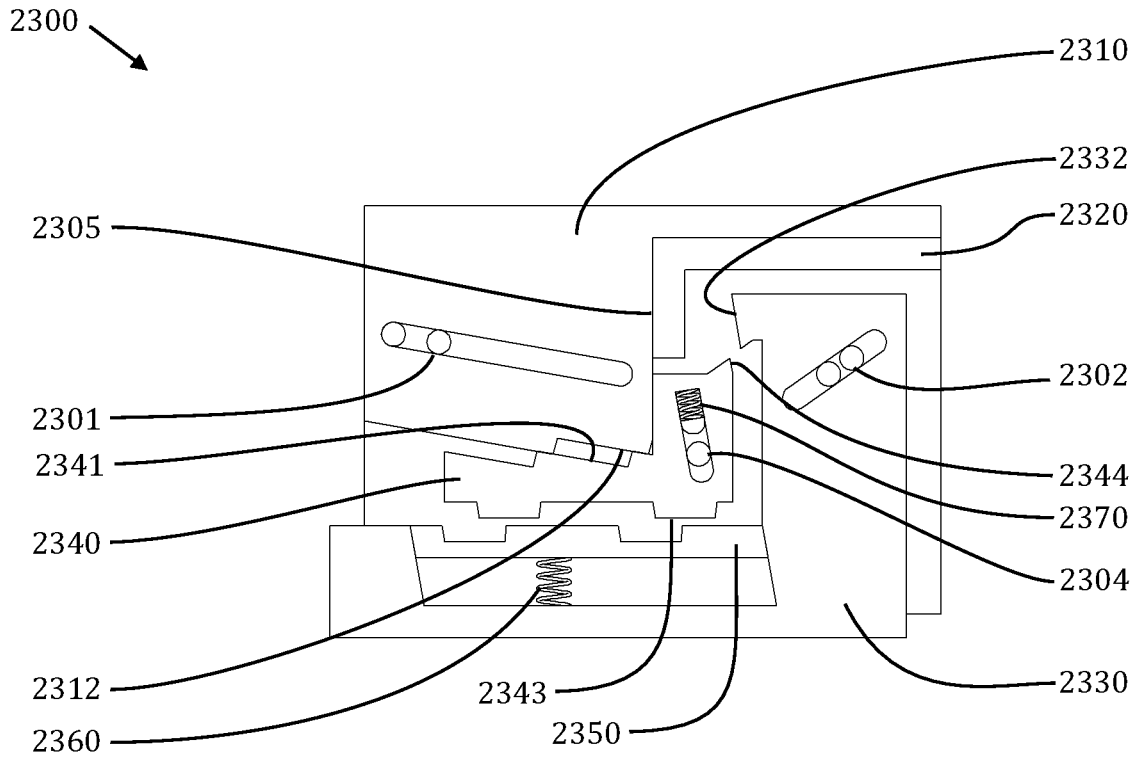
FIGS. 11A and 11B, respectively, are schematic elevation and isometric planar projection views of the unlatched and partially axially-extended linkage in FIGS. 8A and 8B, shown after application of rotation in a second direction of the drive cam body, relative to the driven cam body, to a second threshold position from which further rotation in the second direction will cause further extension of the linkage.
Figure 11B:
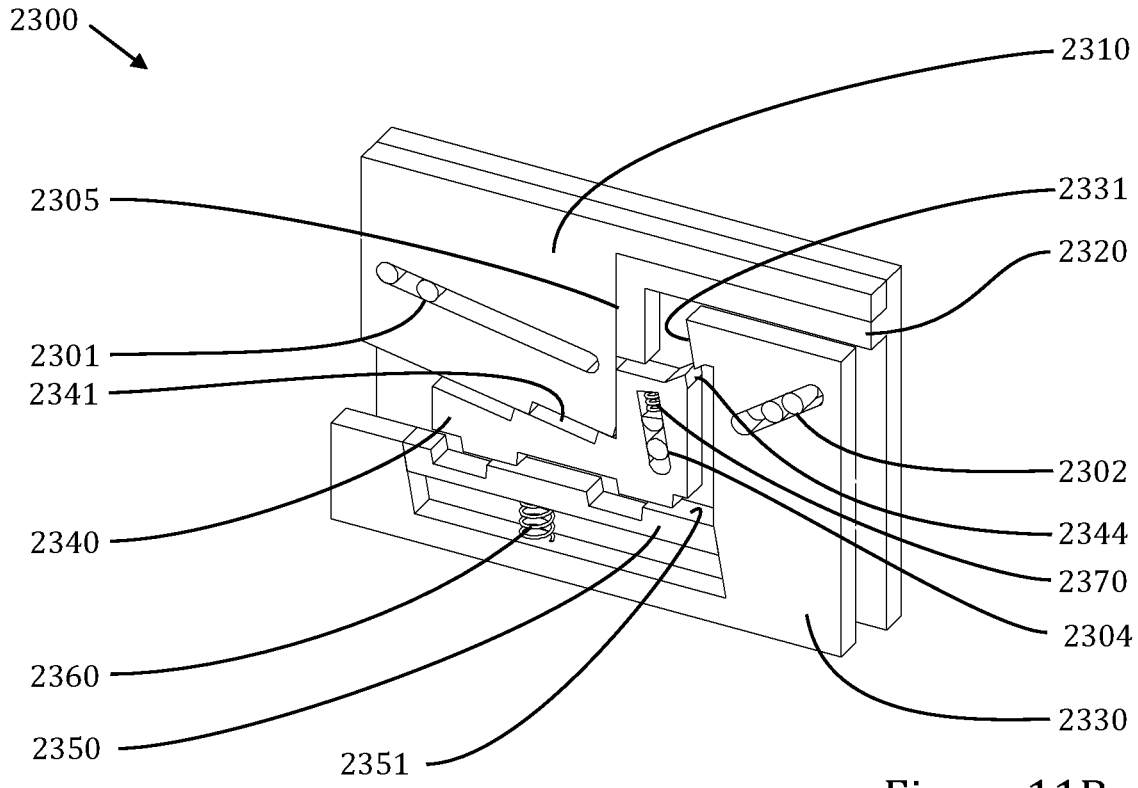

Relative to FIGS. 8A and 8B and to FIGS. 10A and 10B, FIGS. 11A and 11B show rightward movement of drive cam body 2310 relative to driven cam body 2330 with no change in axial extension. Drive cam body 2310 moves relative to intermediate cam body 2320 along the path defined by drive pin-slot mechanism 2301, and intermediate cam body 2320 simultaneously moves relative to driven cam body 2330 along the path defined by driven pin-slot mechanism 2302. At the operational position shown in FIGS. 11A and 11B, primary drive thread stop 2305 between drive cam body 2310 and intermediate cam body 2320 has been engaged, and any further rightward movement of drive cam body 2310 relative to driven cam body 2330 would be translated into further axial extension and increased radial gripping force between grip surfaces 1240 and a workpiece. Drive cam body 2310 has moved latch body 2340 to its latching position by the action of contacting and sliding cam surfaces 2312 and 2341. However, linkage 2300 remains unlatched because it is axially extended such that latch body 2340 cannot engage striker body 2350.

Figure 12A:
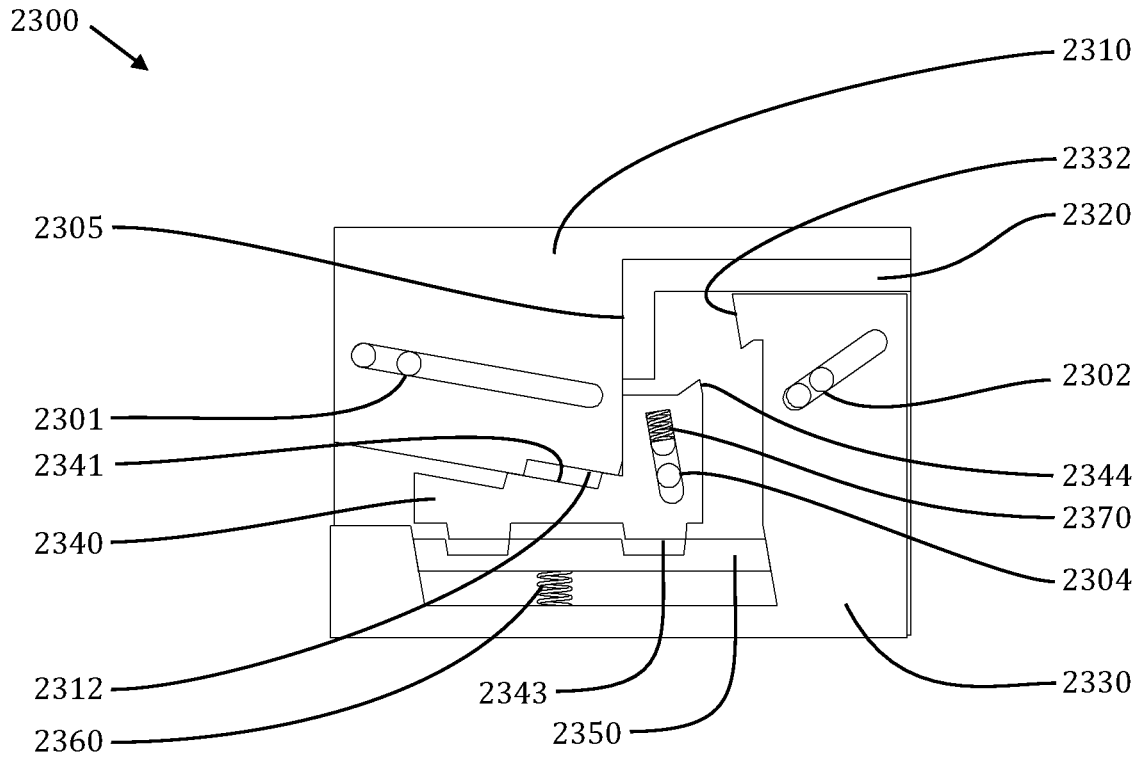
FIGS. 12A and 12B, respectively, are schematic elevation and isometric planar projection views of the linkage in FIGS. 6A and 6B, shown at one position on the re-latching limit envelope of the linkage.
Figure 12B:
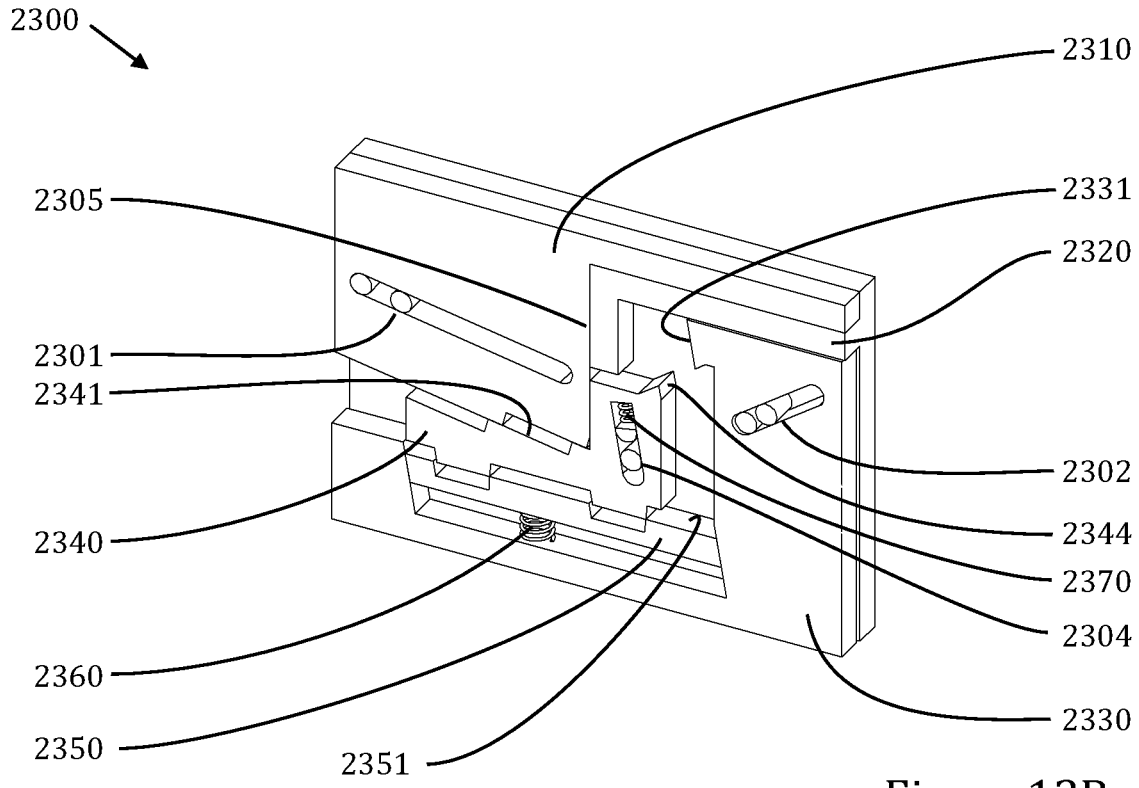

To re-latch linkage 2300, it must be axially retracted. FIGS. 12A and 12B show linkage 2300 in a position analogous to one position on the re-latch limit illustrated in FIG. 4—specifically, where the re-latch limit intersects the breakout ramp line in FIG. 4. Latch body 2340 contacts striker body 2350, compressing first biasing means 2360, because latch body 2340 and striker body 2350 are not sufficiently transversely aligned to allow mating engagement. Further axial retraction and associated transverse movement of linkage 2300 (along the breakout ramp line) will align latch body 2340 and striker body 2350 to allow mating engagement and return linkage 2300 to the latched position as shown in FIGS. 6A and 6B.

FIGS. 13A, 13B, 14A, 14B, 15A, 15B, 16A, 16B, 17A, 17B, 18A, 18B, 19A and 19B are elevation and cross-section views of axial extension linkage 1300, shown in operational positions analogous to the operational positions of axial extension linkage 2300 described above and shown in FIGS. 6A to 12B.

Figure 13A:
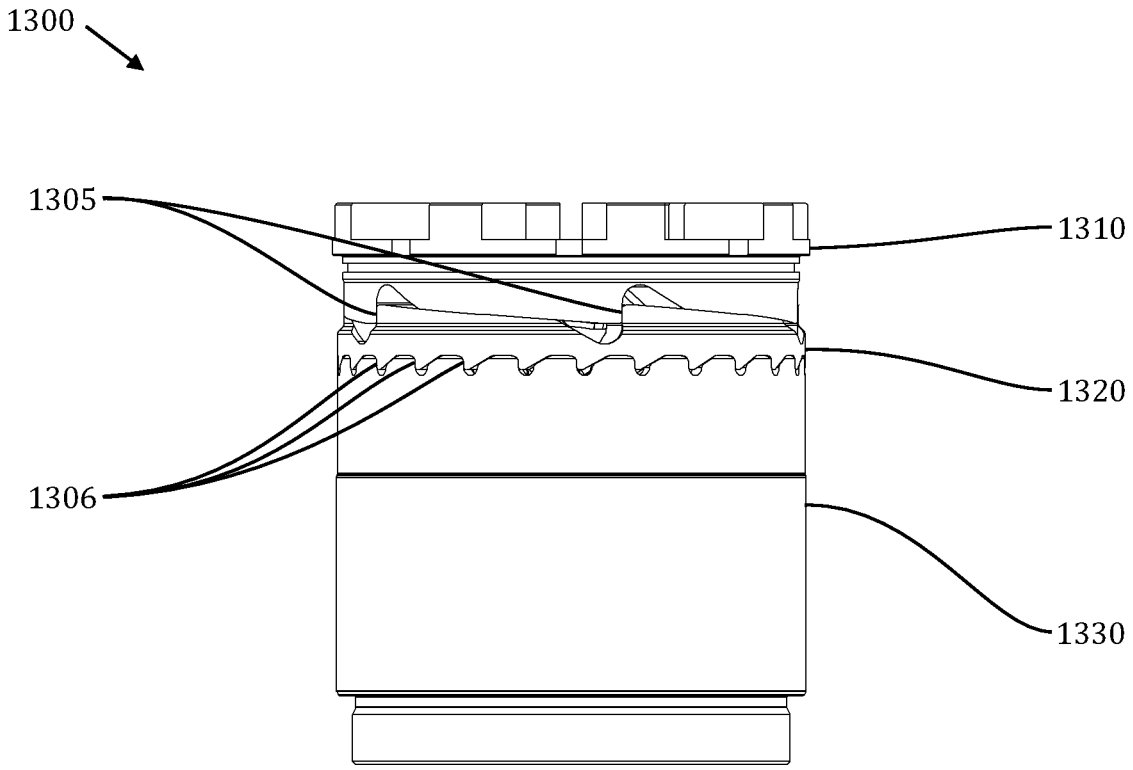
FIGS. 13A and 13B, respectively, are elevation and cross-section views of the linkage in FIGS. 5A and 5B, shown in the latched position, analogous to the schematic planar representations in FIGS. 6A and 6B.
Figure 13B:
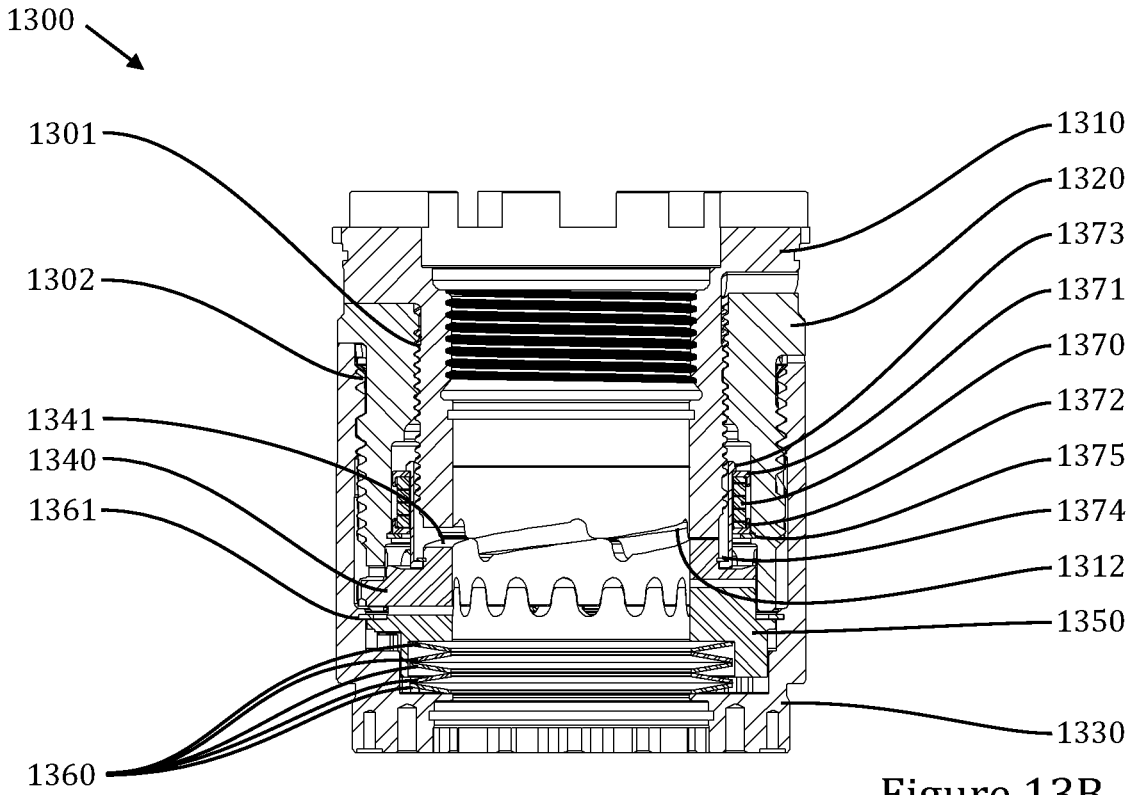

FIGS. 13A and 13B show axial extension linkage 1300 in its latched position. Drive cam body 1310 is in its latching position relative to intermediate cam body 1320. Drive cam body 1310 holds latch body 1340 in its latching position by contact of cam surfaces 1312 and 1341. Striker body 1350 is in its latching position and driven thread 1302 is axially positioned at the limit of its operating range defined by engagement of primary driven thread stop 1306. Latch body 1340 and striker body 1350 are engaged and resist relative movement between intermediate cam body 1320 and driven cam body 1330 along the path defined by driven thread 1302.

Figure 14A:
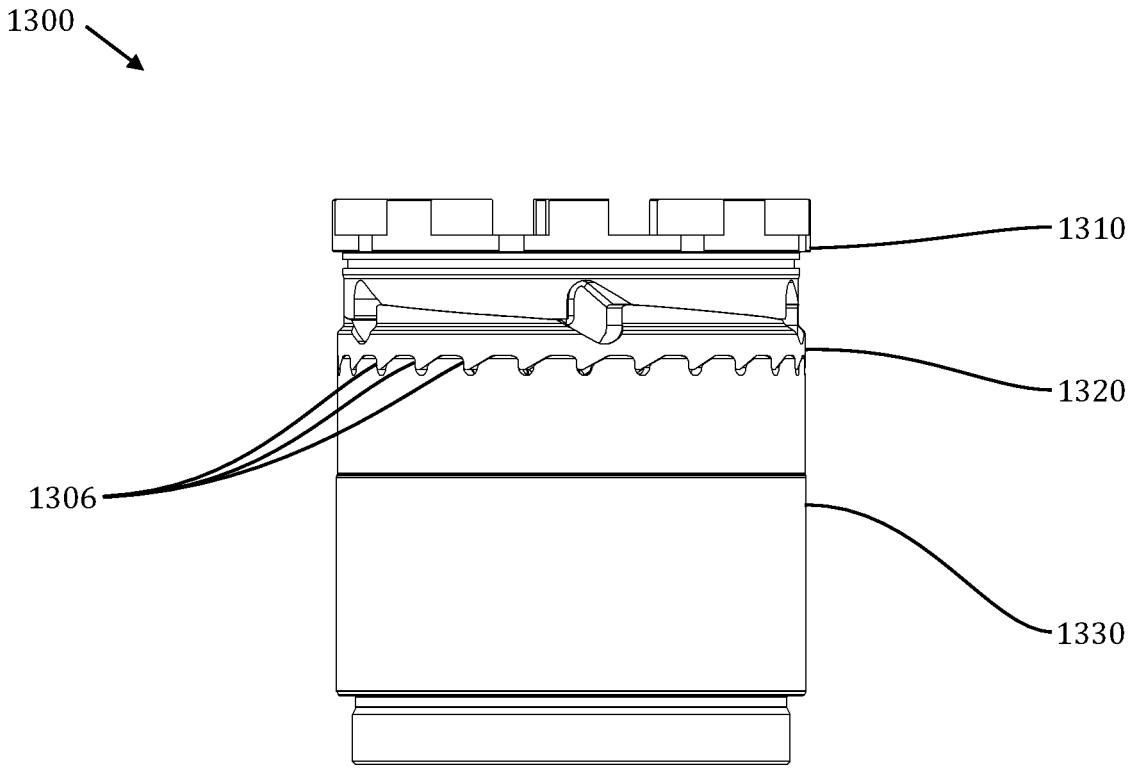
FIGS. 14A and 14B, respectively, are elevation and cross-section views of the linkage in FIGS. 5A and 5B, shown rotated in a first direction to an unlatched position, analogous to the schematic planar representations in FIGS. 7A and 7B.
Figure 14B:
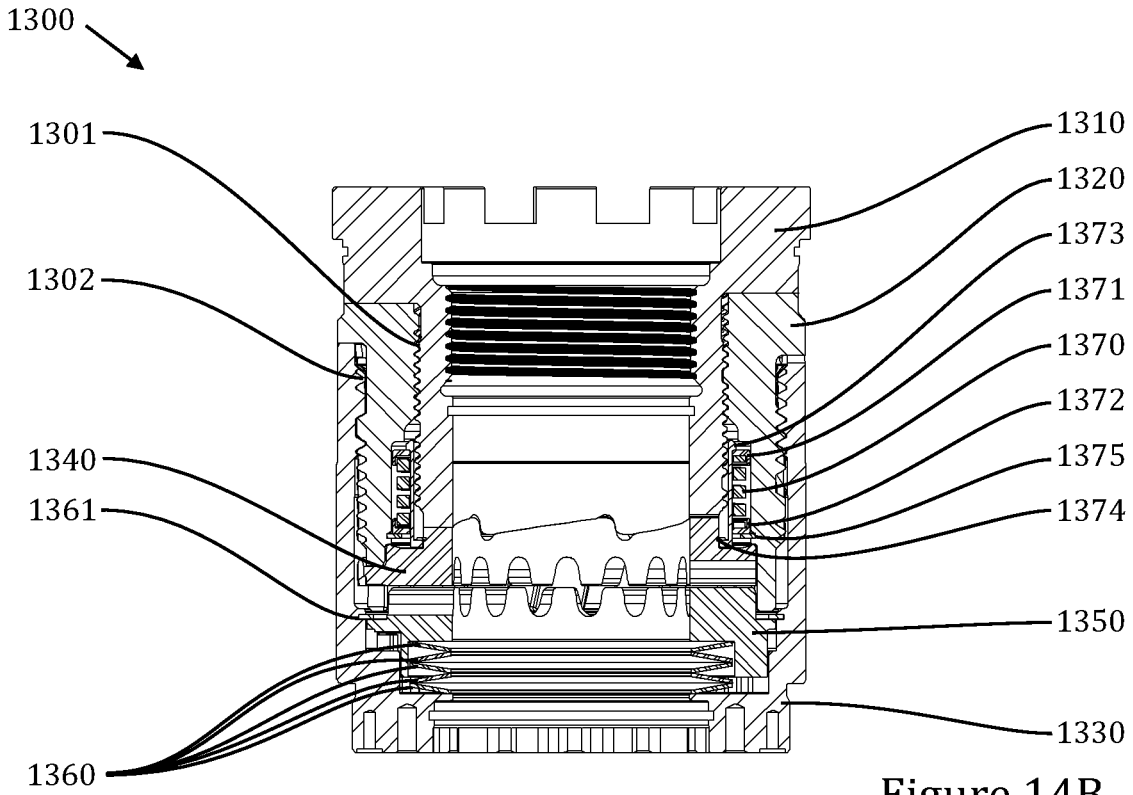

Axial extension linkage 1300 is unlatched by right-hand rotation of drive cam body 1310 relative to driven cam body 1330 along the path defined by drive thread 1301 (as shown by FIGS. 14A and 14B). This right-hand rotation changes the relative positions of cam surface 1312 on drive cam body 1310 and cam surface 1341 on latch body 1340, which allows latch body 1340 to move upward to its free position urged by coil spring 1370. Latch body 1340 in its free position cannot engage striker body 1350, and intermediate cam body 1320, which carries striker body 1350, may then move relative to driven cam body 1330 along the path defined by driven thread 1302.

When axial extension linkage 1300 is unlatched, axial extension can occur without simultaneous rotation of drive cam body 1310 relative to driven cam body 1330 via drive thread 1301 and driven thread 1302, as can been seen by comparing FIGS. 15A and 15B to FIGS. 14A and 14B. During normal operation of axial extension linkage 1300 installed in CRT 1000, axial extension is limited by CRT 1000 when grip surfaces 1240 of gripping assembly 1200 contact a workpiece. In abnormal operation (such as when an axial extension linkage 1300 is unlatched and no workpiece is present), axial extension of axial extension linkage 1300 is limited by contact of shoulder surfaces 1344 on latch body 1340 and shoulder surfaces 1332 on driven cam body 1330, as shown in FIGS. 16A and 16B.

Relative to FIGS. 15A and 15B, FIGS. 17A and 17B show right-hand rotation of drive cam body 1310 relative to driven cam body 1330 with no change in axial extension. Drive cam body 1310 moves relative to intermediate cam body 1320 along the path defined by drive thread 1301, and intermediate cam body 1320 simultaneously moves relative to driven cam body 1330 along the path defined by driven thread 1302. At the operational position shown in FIGS. 17A and 17B, primary driven thread stop 1306 between intermediate cam body 1320 and driven cam body 1330 has been engaged, and any further right-hand rotation of drive cam body 1310 relative to driven cam body 1330 would be translated into further axial extension and thus increased radial gripping force between grip surfaces 1240 and a workpiece.

Figure 15A:
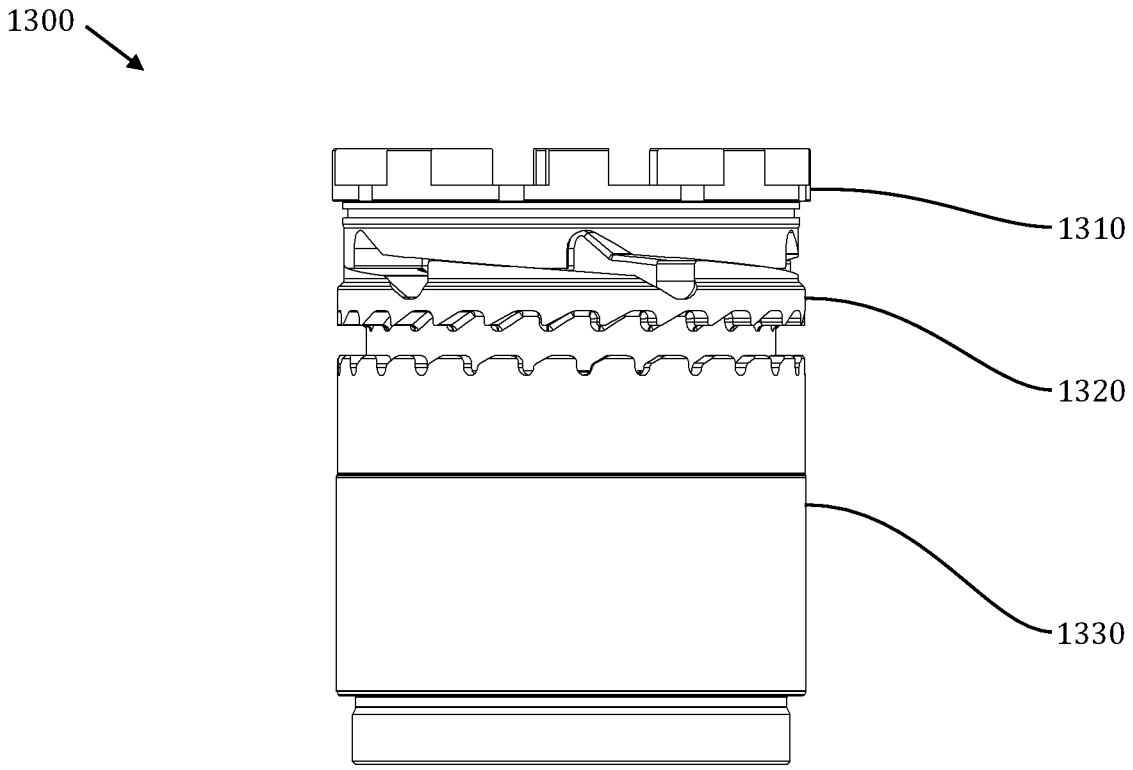
FIGS. 15A and 15B, respectively, are elevation and cross-section views of the linkage in FIGS. 5A and 5B, shown in a partially-extended position, analogous to the schematic planar representations in FIGS. 8A and 8B.
Figure 15B:
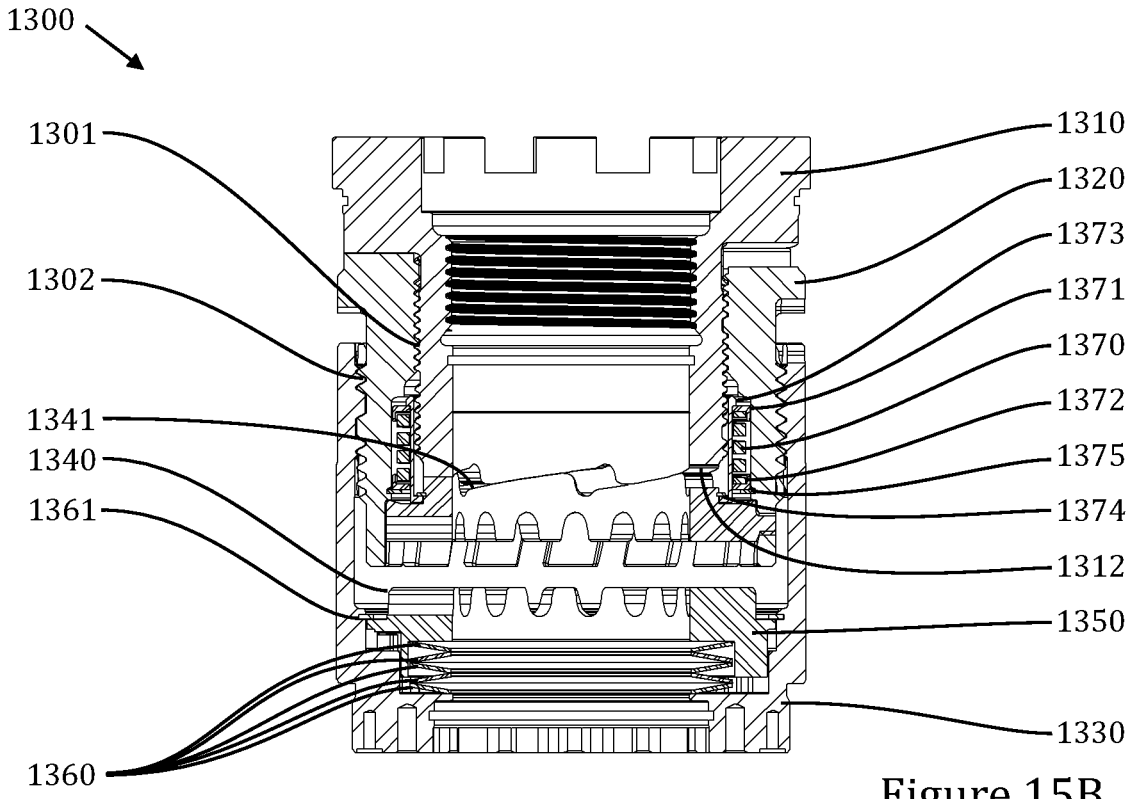
Figure 16A:
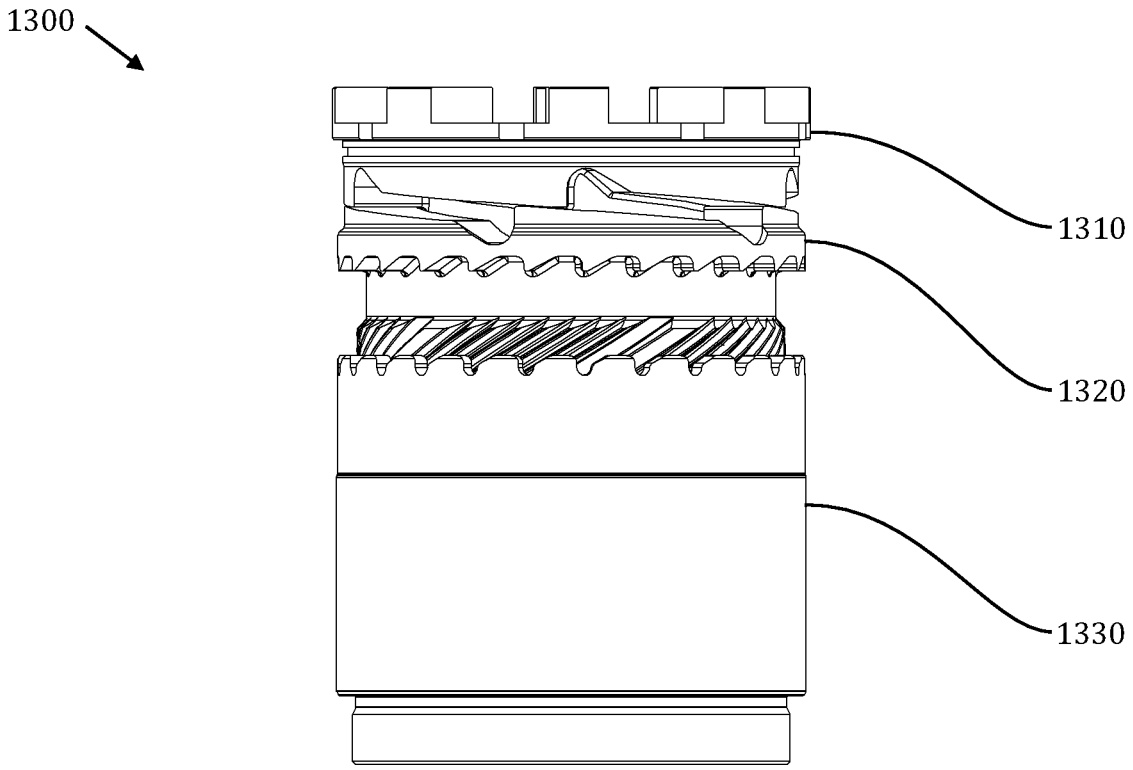
FIGS. 16A and 16B, respectively, are elevation and cross-section views of the linkage in FIGS. 5A and 5B, shown in a fully extended position, analogous to the schematic planar representations in FIGS. 9A and 9B.
Figure 16B:
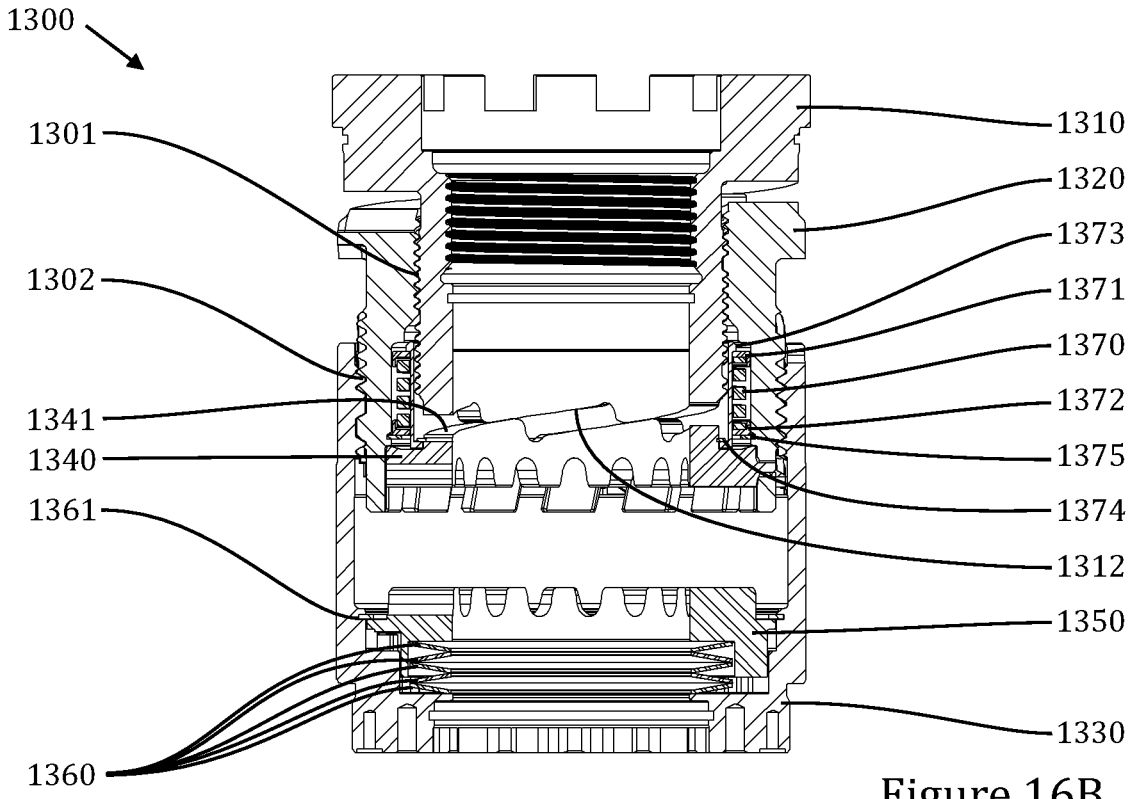
Figure 17A:
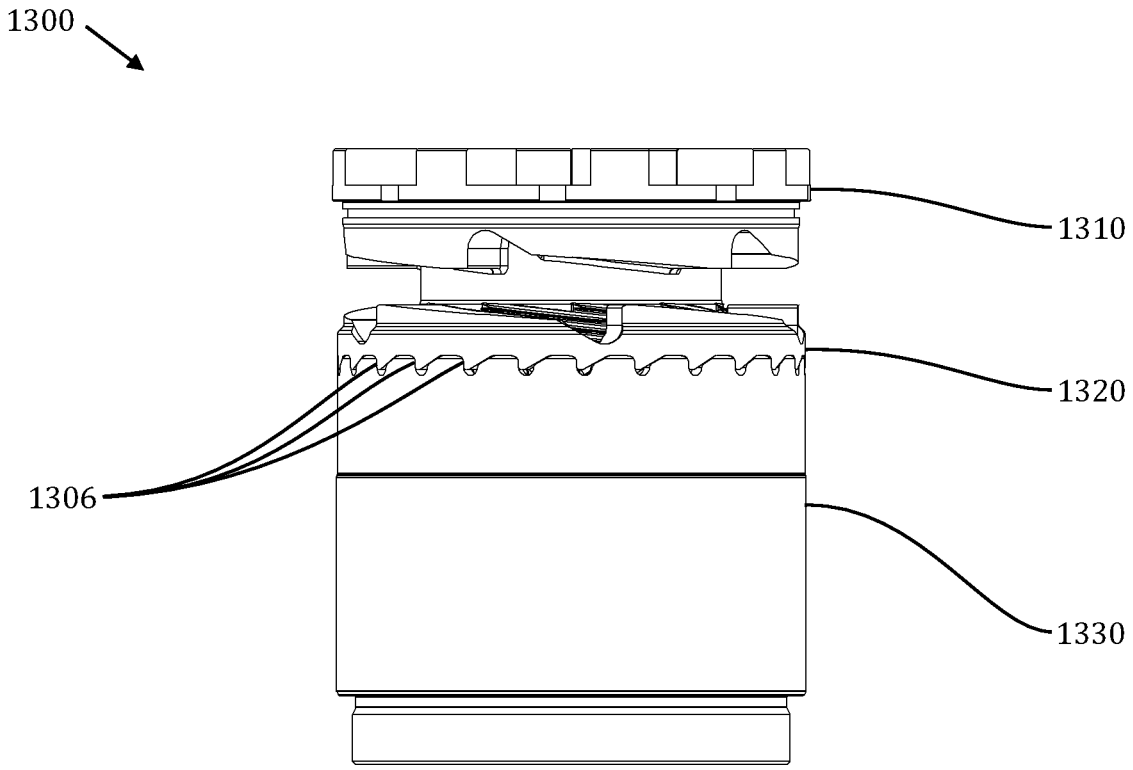
FIGS. 17A and 17B, respectively, are elevation and cross-section views of the linkage in FIGS. 5A and 5B, shown rotated further in the first direction, analogous to the schematic planar representations in FIGS. 10A and 10B.
Figure 17B:
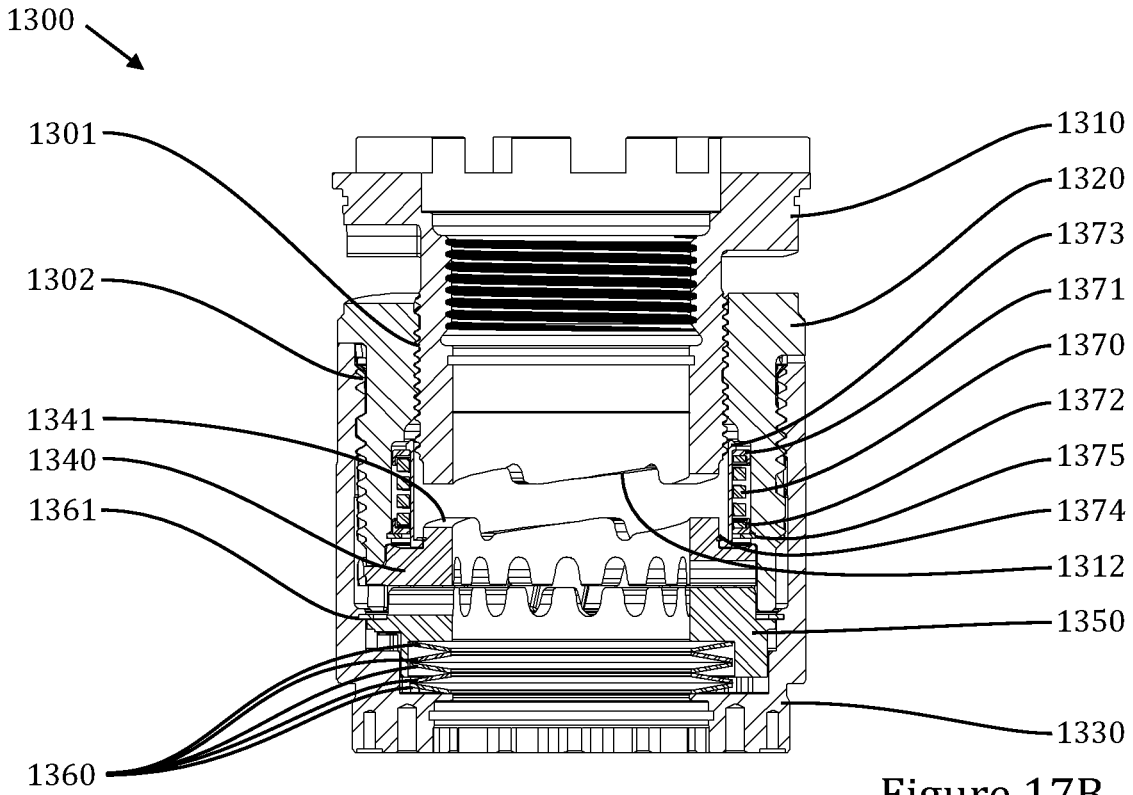
Figure 18A:
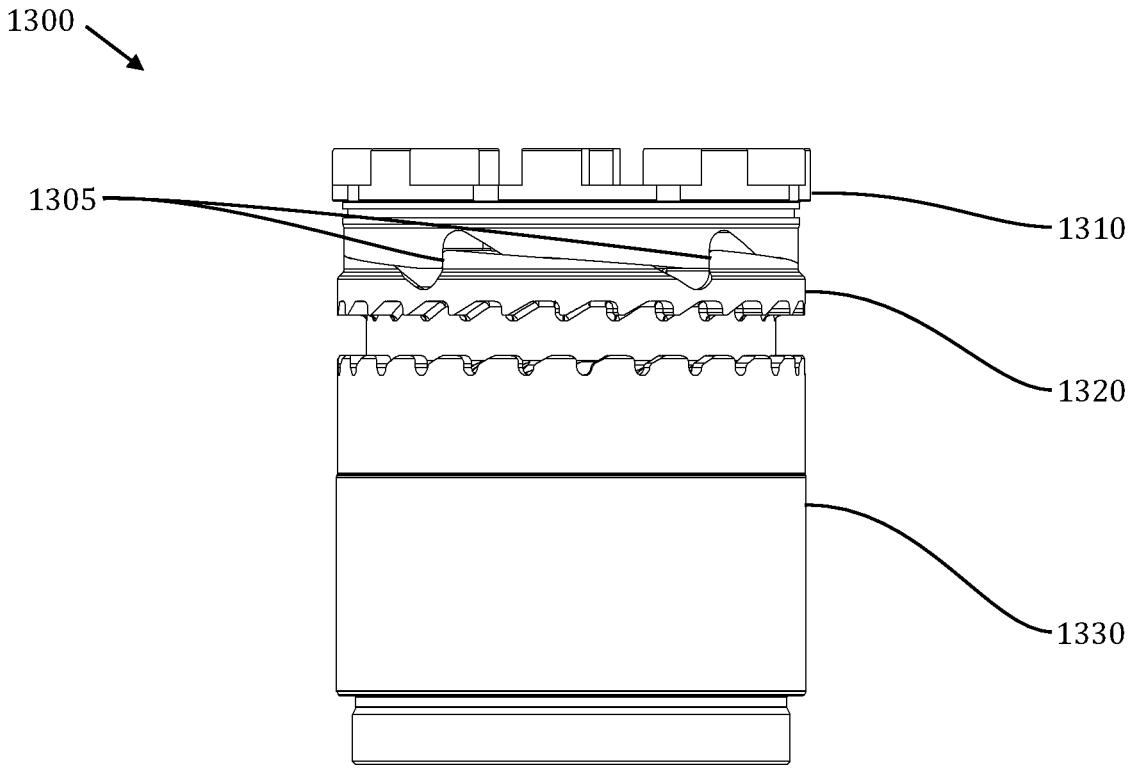
FIGS. 18A and 18B, respectively, are elevation and cross-section views of the linkage in FIGS. 5A and 5B, shown in a second direction, analogous to the schematic planar representations in FIGS. 11A and 11B.
Figure 18B:
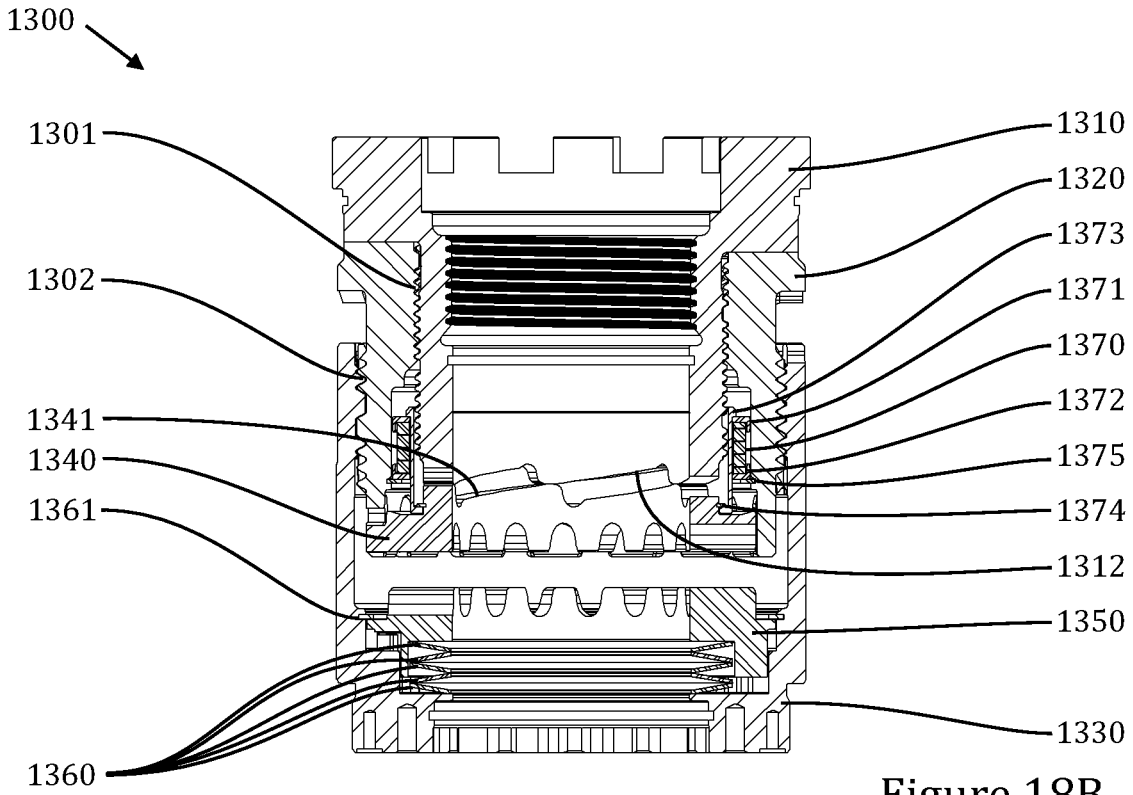

Relative to FIGS. 15A and 15B and to FIGS. 17A and 17B, FIGS. 18A and 18B show left-hand rotation of drive cam body 1310 relative to driven cam body 1330 with no change in axial extension. Drive cam body 1310 moves relative to intermediate cam body 1320 along the path defined by drive thread 1301, and intermediate cam body 1320 simultaneously moves relative to driven cam body 1330 along the path defined by driven thread 1302. At the operational position shown in FIGS. 18A and 18B, primary drive thread stop 1305 between drive cam body 1310 and intermediate cam body 1320 has been engaged, and any further left-hand rotation of drive cam body 1310 relative to driven cam body 1330 would be translated into further axial extension and increased radial gripping force between grip surfaces 1240 and a workpiece. Drive cam body 1310 has moved latch body 1340 to its "latching" position by the action of contacting and sliding cam surfaces 1312 and 1341. However, axial extension linkage 1300 remains unlatched because it is axially extended such that latch body 1340 cannot engage striker body 1350.

Figure 19A:
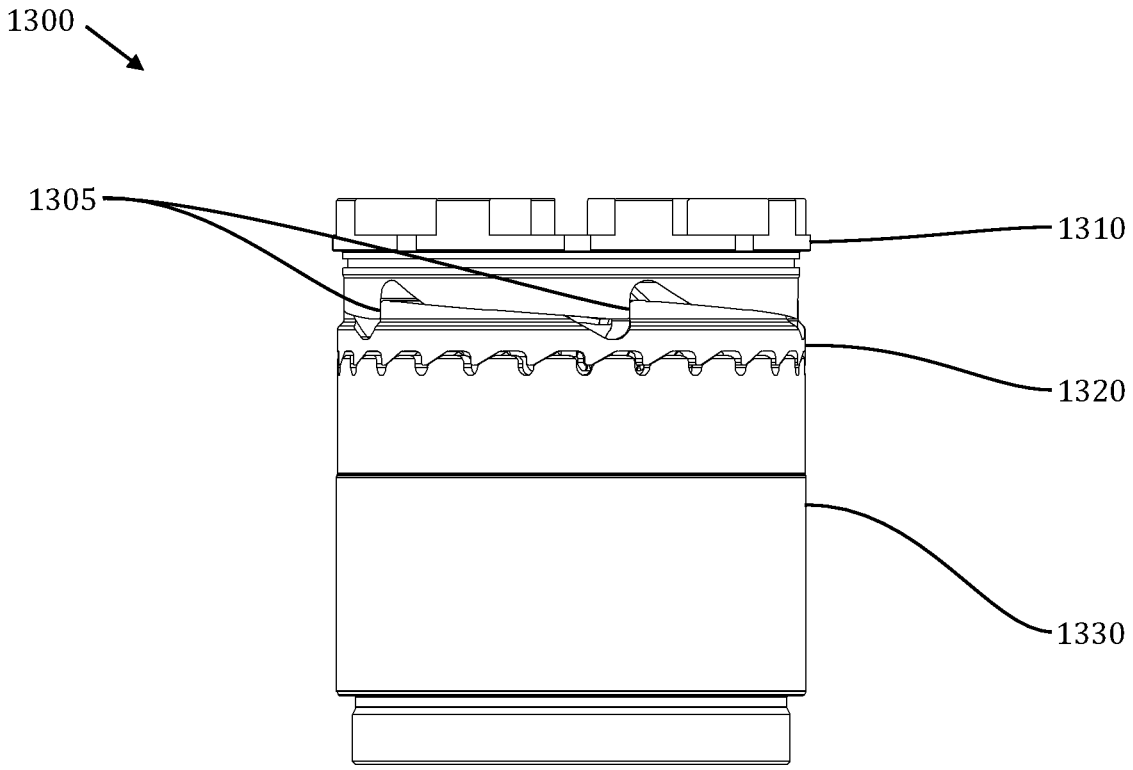
FIGS. 19A and 19B, respectively, are elevation and cross-section views of the linkage in FIGS. 5A and 5B, shown at one position on the re-latching limit envelope of the linkage, analogous to the schematic planar representations in FIGS. 12A and 12B.
Figure 19B:
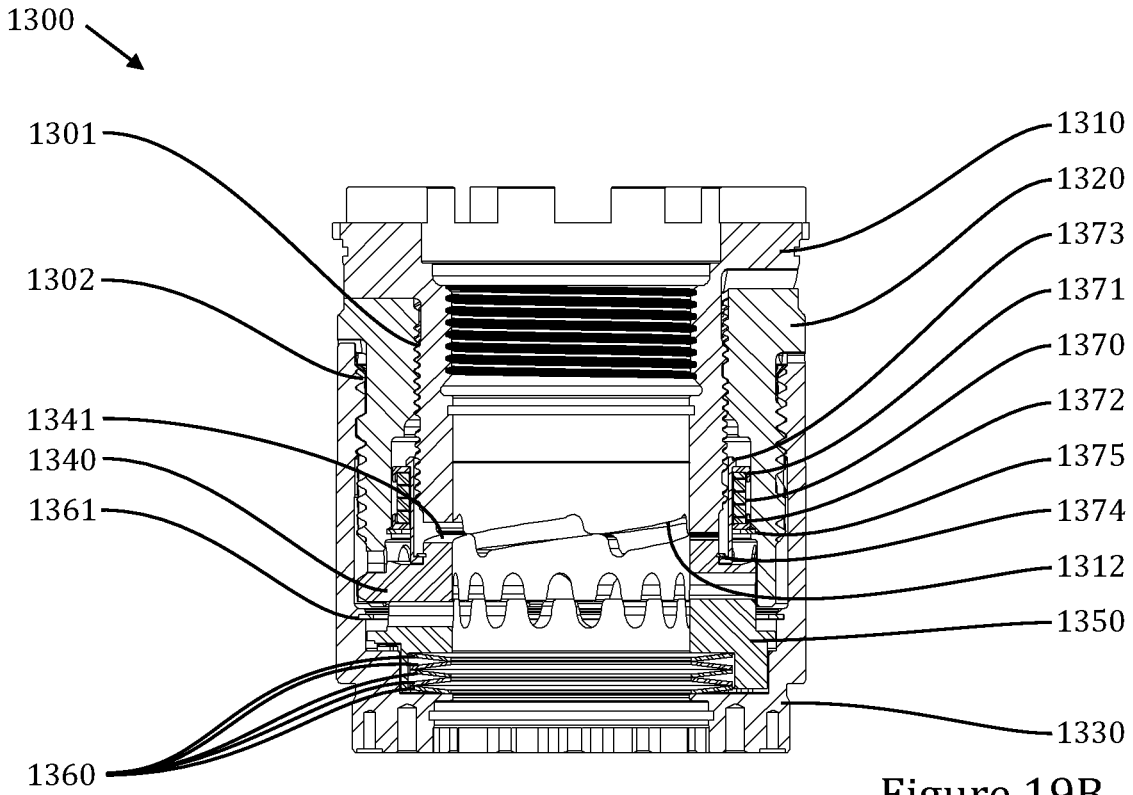

To re-latch axial extension linkage 1300, it must be axially retracted. FIGS. 19A and 19B show axial extension linkage 1300 in one position on the re-latch limit illustrated in FIG. 4—specifically, where the re-latch limit intersects the breakout ramp line in FIG. 4. Latch body 1340 contacts striker body 1350 compressing conical spring washers 1360 because latch body 1340 and striker body 1350 are not sufficiently rotationally aligned to allow mating engagement. Further axial retraction (and associated rotation) of axial extension linkage 1300 will align latch body 1340 and striker body 1350 to allow mating engagement and return axial extension linkage 1300 to the latched position as shown in FIGS. 13A and 13B.

Figure 20:
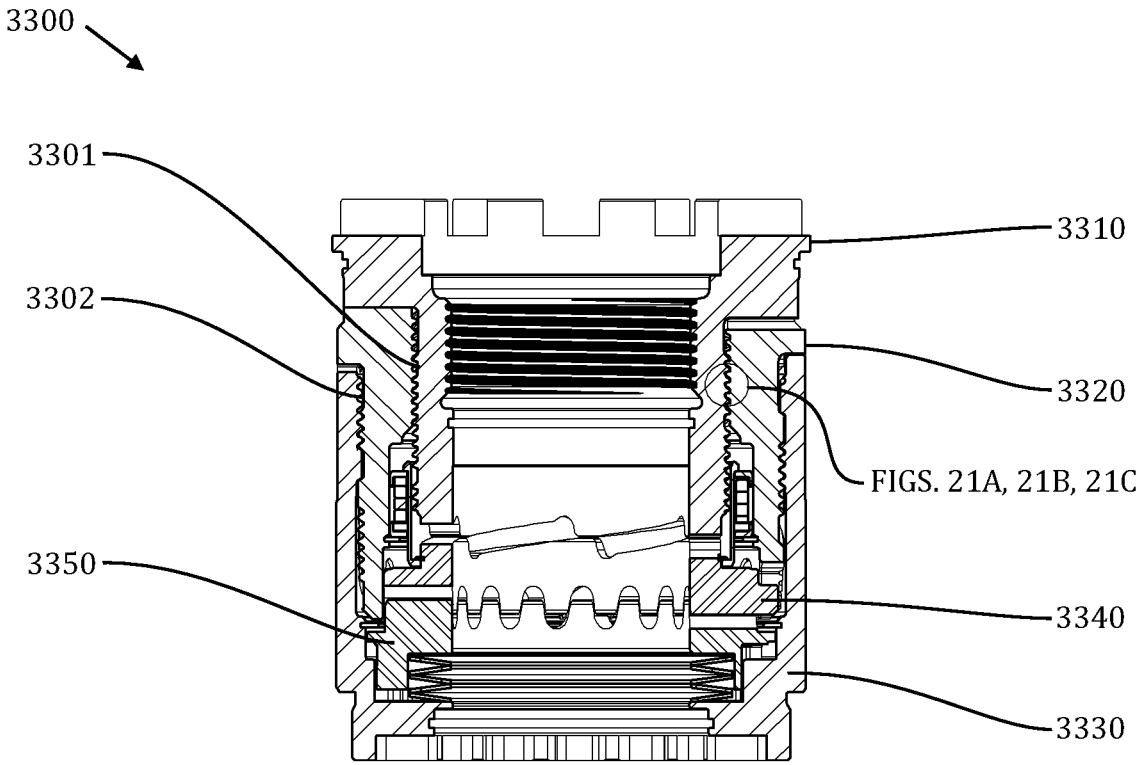
FIG. 20 is a cross-section view of a second embodiment of an axial extension linkage in accordance with the present disclosure wherein the drive thread has an asymmetric threadform, with the tension flank angle and compression flank angle differing in magnitude.

FIG. 20 is a cross-section view of a second embodiment 3300 of an axial extension linkage in accordance with the present disclosure. Axial extension linkage 3300 is configured for use in prior art internally-gripping CRT 1000, and comprises a drive cam body 3310, an intermediate cam body 3320, a driven cam body 3330, a latch body 3340, and a striker body 3350. Drive cam body 3310 and intermediate cam body 3320 are threadingly engaged via a drive thread 3301. Intermediate cam body 3320 and driven cam body 3330 are threadingly engaged via a driven thread 3302.

Figure 21A:
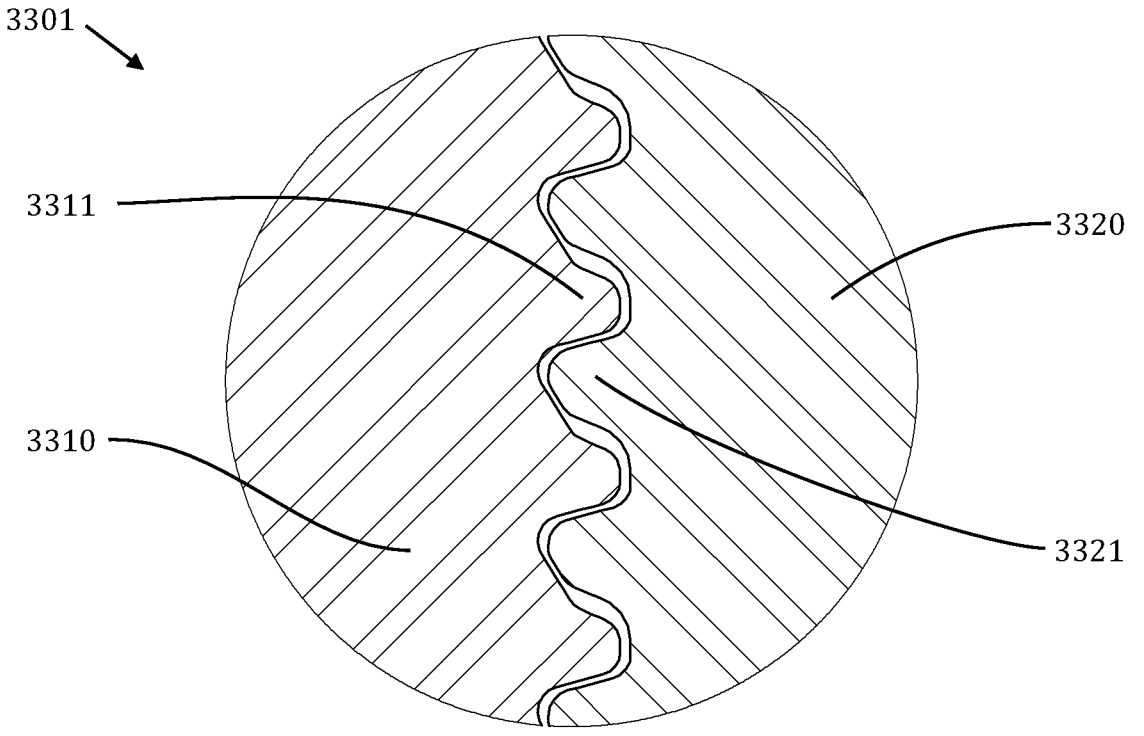
FIG. 21A is a detail view of the drive thread of the axial extension linkage in FIG. 20.

FIG. 21A is a detail view of drive thread 3301. Drive thread 3301 comprises an external multi-start thread 3311 on drive cam body 3310 engaging an internal multi-start thread 3321 on intermediate cam body 3320.

Figure 21B:
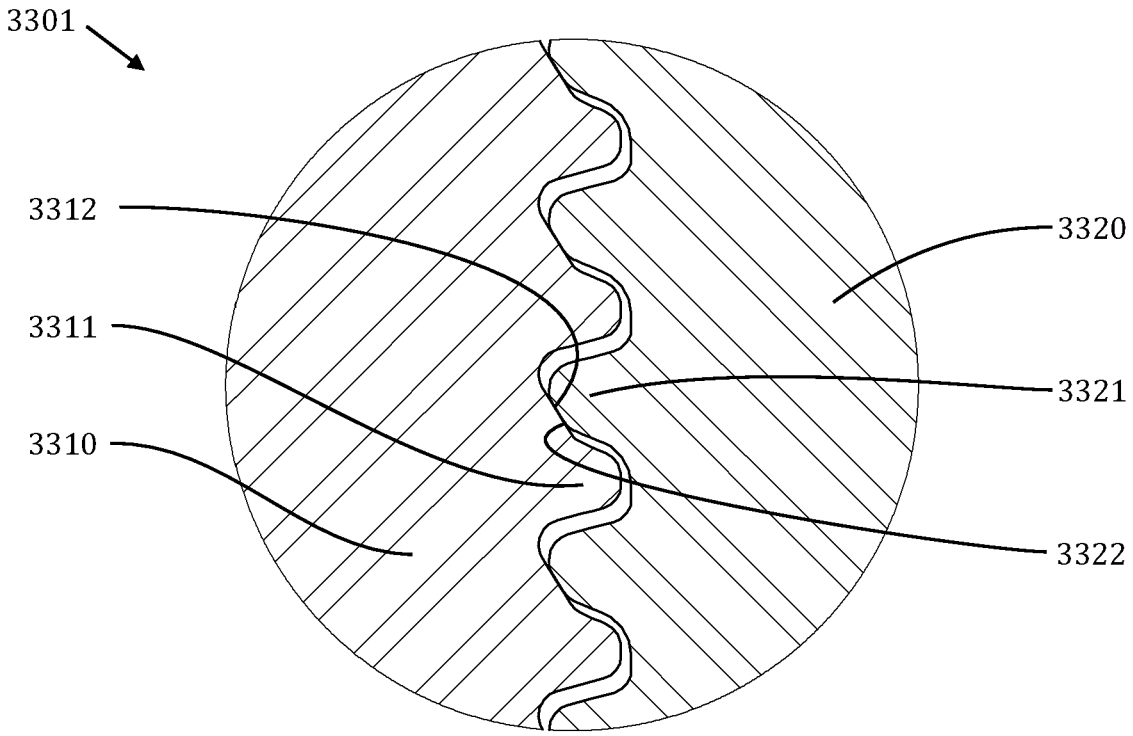
FIG. 21B is a detail view of the drive thread of the axial extension linkage in FIG. 20, shown with the tension flanks in contact.

CRT 1000 includes an internal air spring acting in combination with gravity to stroke gripping assembly 1200 toward engagement with a workpiece. When axial extension linkage 3300 is latched, the forces of the internal air spring and gravity may be transmitted through axial extension linkage 3300 as a tensile axial force urging movement of both drive thread 3301 and driven thread 3302. Mating engagement of latch body 3340 and striker body 3350 will resist movement of driven thread 3302. Tensile axial force transmitted through axial extension linkage 3300 will also urge contact between the tension flank 3312 of external multi-start thread 3311 and the tension flank 3322 of internal multi-start thread 3321, as shown in FIG. 21B. Movement of drive thread 3301 will be resisted by friction between the tension flanks 3312 and 3322.

Unintentional unlatching of axial extension linkage 3300 and activation of the CRT 1000 may occur when the resistance to rotary unlatching movement of drive thread 3301 generated by friction between tension flanks 3312 and 3322 is low. To avoid this potential problem, the frictional resistance to rotation may be increased by increasing the angle of tension flanks 3312 and 3322.

Figure 21C:
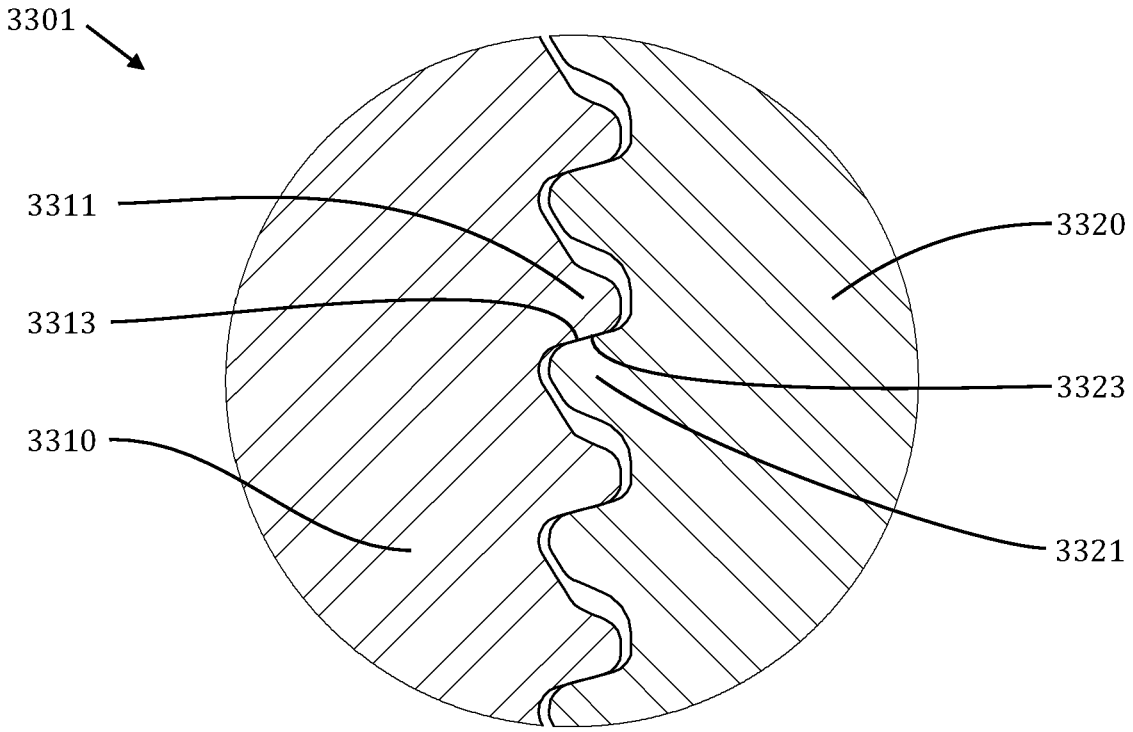
FIG. 21C is a detail view of the drive thread of the axial extension linkage in FIG. 20, shown with the compression flanks in contact.

When axial extension linkage 3300 is unlatched and operated to translate bi-directional rotation of load adaptor 1110 relative to grip surfaces 1240 into axial movement to drive axial-stroke activation of gripping assembly 1200, a compressive axial force will be generated in axial extension linkage 3300 and will urge contact between the compression flank 3313 of external multi-start thread 3311 and the compression flank 3323 of internal multi-start thread 3321, as shown in FIG. 21C. It may be desirable to reduce the frictional resistance to rotary movement of drive thread 3301 when axial extension linkage 3300 transmits compressive force, and this may be achieved by reducing the angle of compression flanks 3313 and 3323.

Accordingly, asymmetric threadforms may be selected for drive thread 3301 such that the angle of tension flanks 3312 and 3322 differ in magnitude from the angle of compression flanks 3313 and 3323.

Figure 22A:
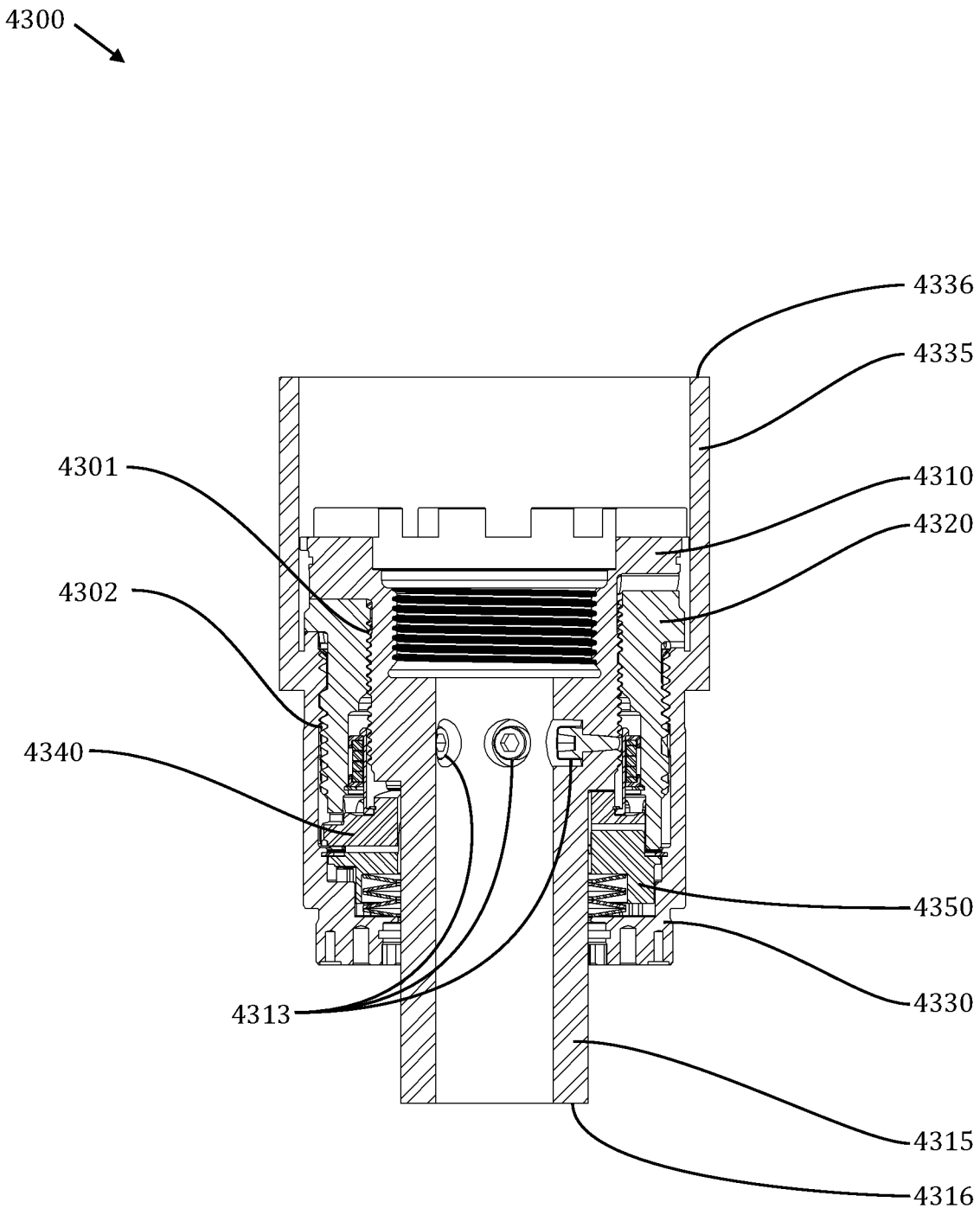
FIG. 22A is a cross-section view of an embodiment of an axial retraction linkage in accordance with the present disclosure, shown in the latched position.

FIG. 22A is a cross-section view of an embodiment 4300 of an axial retraction linkage in accordance with the present disclosure, shown in the latched position. Axial retraction linkage 4300 comprises a drive cam body 4310, an intermediate cam body 4320, a driven cam body 4330, a latch body 4340, and a striker body 4350. Drive cam body 4310 and intermediate cam body 4320 are threadingly engaged via a drive thread 4301. Intermediate cam body 4320 and driven cam body 4330 are threadingly engaged via a driven thread 4302.

Axial retraction linkage 4300 is a modification of axial extension linkage 1300 and is not retrofittable into prior art CRT 100 or prior art CRT 1000. Unlike the illustrated embodiment of driven cam 1330, driven cam 4330 further comprises a driven cam extension 4335, having an upper end 4336. Upper end 4336 of driven cam extension 4335 may be configured to enable the application of external axial load and torque by any means known to persons of ordinary skill in the art. Unlike the illustrated embodiment of drive cam 1310, drive cam 4310 further comprises a drive cam extension 4315, having a lower end 4316. Lower end 4316 of drive cam extension 4315 may be adapted to enable the application of external axial load and torque by any means known to persons of ordinary skill in the art.

Figure 22B:
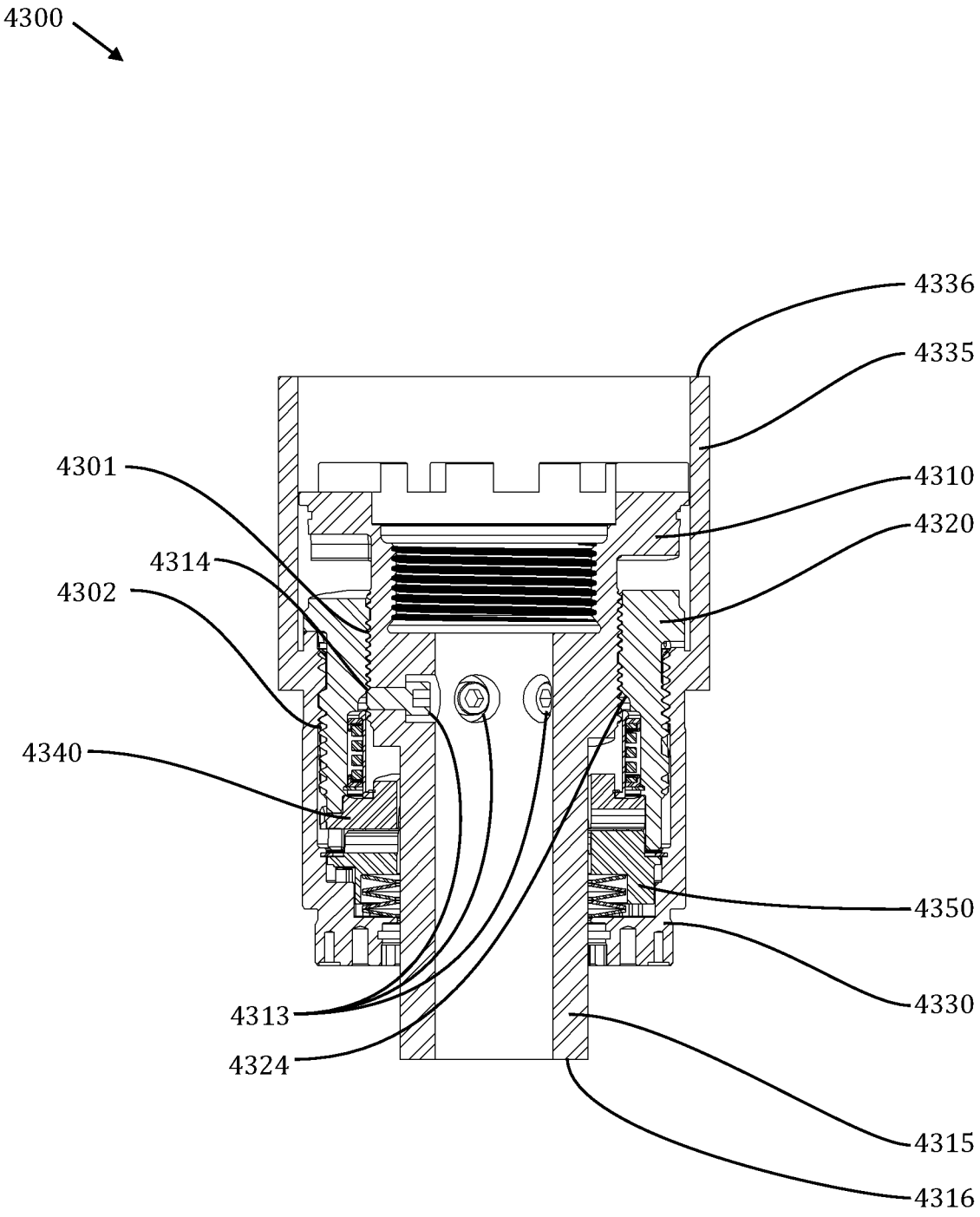
FIG. 22B is a cross-section view of the axial retraction linkage in FIG. 22A, shown unlatched with the drive thread rotated to engage a secondary drive thread stop.

As shown in FIG. 22B, axial retraction linkage 4300 further comprises a secondary drive thread stop, provided by shoulder surfaces 4314 formed on the ends of lugs 4313, which are mounted to drive cam 4310, and configured for abutting contact with a shoulder surface 4324 on intermediate cam body 4320. FIG. 22B is a cross-section view of axial retraction linkage 4300, shown unlatched and with drive thread 4301 rotated such that shoulder surfaces 4314 on lugs 4313 contact shoulder surface 4324 on intermediate cam body 4320, thus limiting the operating range of drive thread 4301.

All other parts of axial retraction linkage 4300 are identical to the correspondingly arranged parts of axial extension linkage 1300. Accordingly, the internal operation of axial retraction linkage 4300 is identical to the internal operation of axial extension linkage 1300, with the addition of the secondary drive thread stop. Due to the configuration of drive cam extension 4315 and driven cam extension 4335, axial retraction linkage 4300 is latched at its longest length and retracts when unlatched. In comparison, axial extension linkage 1300 is latched at its shortest length and extends when unlatched.

Figure 22C:
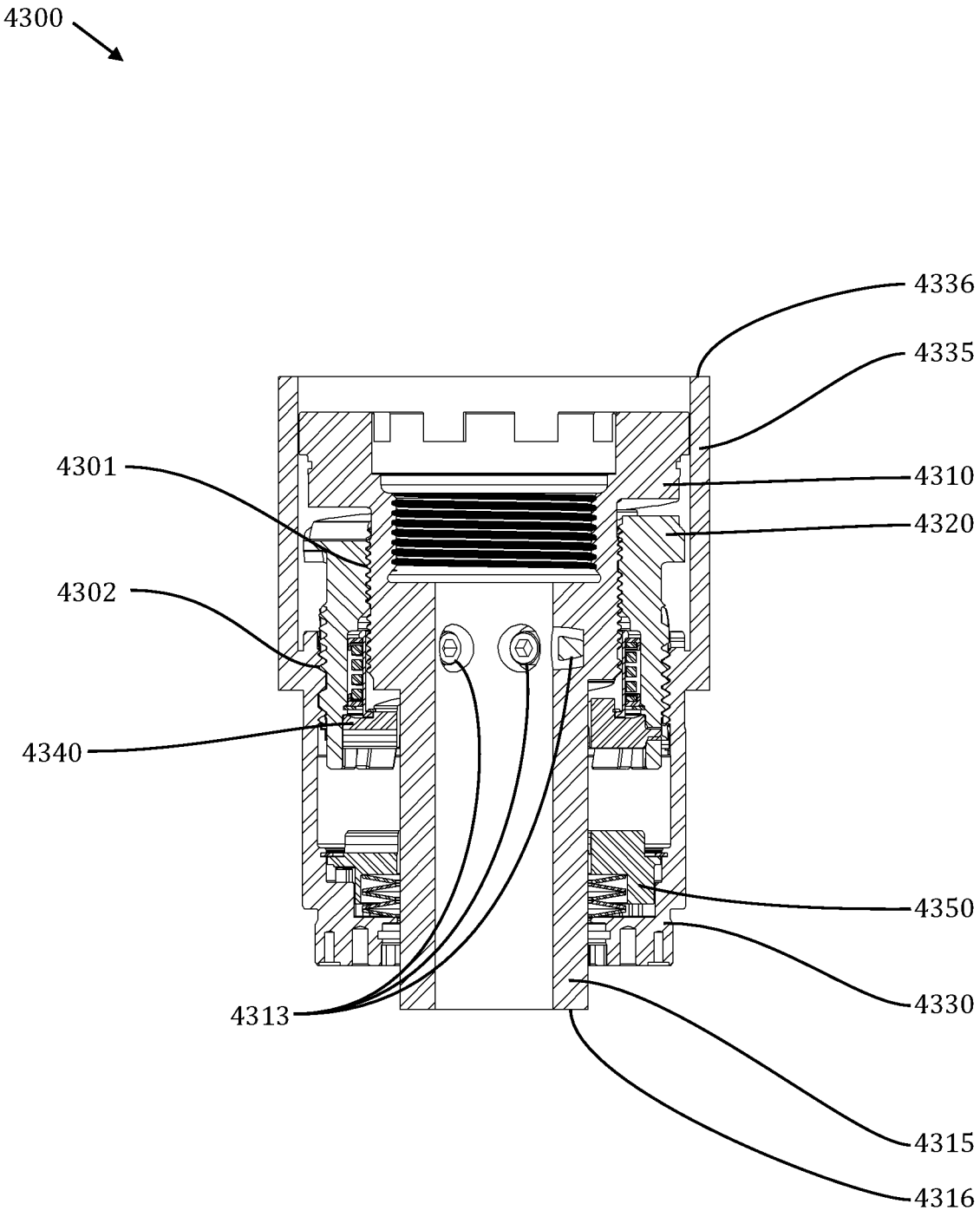
FIG. 22C is a cross-section view of the axial retraction linkage in FIG. 22A, shown unlatched and axially retracted to engage a secondary driven thread stop.

FIG. 22C is a cross-section view of axial retraction linkage 4300, shown unlatched and axially retracted to engage a secondary driven thread stop. This internal operational state of axial retraction linkage 4300 shown in FIG. 22C is identical to the internal operation state of axial extension linkage 1300 shown in FIGS. 16A and 16B.

It will be readily appreciated by persons skilled in the art that various modifications to embodiments in accordance with the present disclosure may be devised without departing from the scope of the present teachings, including modifications that use equivalent structures or materials hereafter conceived or developed.

It is especially to be understood that the scope of the present disclosure is not intended to be limited to described or illustrated embodiments, and that the substitution of a variant of any claimed or illustrated element or feature, without any substantial resultant change in functionality, will not constitute a departure from the scope of the disclosure.

In this patent document, any form of the word "comprise" is to be understood in its non-limiting sense to mean that any element or feature following such word is included, but elements or features not specifically mentioned are not excluded. A reference to an element or feature by the indefinite article "a" does not exclude the possibility that more than one such element or feature is present, unless the context clearly requires that there be one and only one such element or feature.

Any use herein of any form of the terms "connect", "engage", "couple", "attach", or any other term describing an interaction between elements is not meant to limit the interaction to direct interaction between the subject elements, and may also include indirect interaction between the elements such as through secondary or intermediary structure.

Relational and conformational terms such as (but not limited to) "parallel", and "axial", and "coaxial" are not intended to denote or require absolute mathematical or geometrical precision. Accordingly, such terms are to be understood as denoting or requiring substantial precision only (e.g., "substantially parallel") unless the context clearly requires otherwise.

Wherever used in this document, the terms "typical" and "typically" are to be understood and interpreted in the sense of being representative of common usage or practice, and are not intended to be understood or interpreted as implying essentiality or invariability.

LIST OF ILLUSTRATED ELEMENTS

| Element Number | Description |
|---|---|
| 100 | CRT (casing running tool) |
| 101 | tubular workpiece |
| 110 | main body assembly |

-continued

LIST OF ILLUSTRATED ELEMENTS

| Element Number | Description |
|---|---|
| 111 | load adaptor |
| 112 | threaded connection |
| 120 | gripping assembly |
| 121 | bumper |
| 122 | land surface |
| 123 | cage |
| 130 | (prior art) axial extension linkage |
| 131 | drive cam body |
| 132 | intermediate cam body |
| 133 | driven cam body |
| 134 | cam latch body |
| 135 | drive cam hook |
| 136 | cam latch hook |
| 137 | drive thread |
| 138 | driven helical ramp |
| 1000 | CRT (casing running tool) |
| 1100 | main body assembly |
| 1110 | load adaptor |
| 1120 | threaded connection |
| 1200 | gripping assembly |
| 1210 | bumper |
| 1220 | land surface |
| 1230 | cage |
| 1300 | axial extension linkage |
| 1301 | drive thread |
| 1302 | driven thread |
| 1305 | primary drive thread stop |
| 1306 | primary driven thread stop |
| 1310 | drive cam body |
| 1311 | external multi-start thread - drive cam body |
| 1312 | cam surface - drive cam body |
| 1320 | intermediate cam body |
| 1321 | internal multi-start thread - intermediate cam body |
| 1322 | external multi-start thread - intermediate cam body |
| 1323 | slot - intermediate cam body |
| 1330 | driven cam body |
| 1331 | internal multi-start thread - driven cam body |
| 1332 | shoulder surface - driven cam body |
| 1333 | internal spline surface - driven cam body |
| 1340 | latch body |
| 1341 | cam surface - latch body |
| 1342 | pin - latch body |
| 1343 | latch surface - latch body |
| 1344 | shoulder surface - latch body |
| 1350 | striker body |
| 1351 | latch surface - striker body |
| 1352 | external spline surface - striker body |
| 1360 | conical spring washer |
| 1361 | striker retaining clip |
| 1370 | coil spring |
| 1371 | upper end ring |
| 1372 | lower end ring |
| 1373 | sleeve |
| 1374 | inner retaining clip |
| 1375 | outer retaining clip |
| 2300 | exemplary embodiment |
| 2301 | drive pin-slot mechanism |
| 2302 | driven pin-slot mechanism |
| 2304 | third pin-slot mechanism |
| 2305 | primary drive thread stop |
| 2306 | primary driven thread stop |
| 2310 | drive cam body |
| 2312 | cam surface - drive cam body |
| 2320 | intermediate cam body |
| 2330 | driven cam body |
| 2332 | shoulder surface - driven cam body |
| 2340 | latch body |
| 2341 | cam surface - latch body |
| 2343 | latch surface - latch body |
| 2344 | shoulder surface - latch body |
| 2350 | striker body |
| 2351 | latch surface - striker body |
| 2360 | first biasing means |
| 2370 | second biasing means |
| 3300 | axial extension linkage |

-continued

| LIST OF ILLUSTRATED ELEMENTS | |
|---|---|
| Element Number | Description |
| 3301 | drive thread |
| 3302 | driven thread |
| 3310 | drive cam body |
| 3311 | external multi-start thread - drive cam body |
| 3312 | tension flank - drive thread on drive cam body |
| 3313 | compression flank - drive thread on drive cam body |
| 3320 | intermediate cam body |
| 3321 | internal multi-start thread - intermediate cam body |
| 3322 | tension flank - drive thread on intermediate cam body |
| 3323 | compression flank - drive thread on intermediate cam body |
| 3330 | driven cam body |
| 3340 | latch body |
| 3350 | striker body |
| 4300 | axial retraction linkage |
| 4301 | drive thread |
| 4302 | driven thread |
| 4310 | drive cam body |
| 4313 | lug |
| 4314 | shoulder surface - lug |
| 4315 | drive cam body extension |
| 4316 | drive cam body extension lower end |
| 4320 | intermediate cam body |
| 4324 | shoulder surface - intermediate cam body |
| 4330 | driven cam body |
| 4335 | driven cam body extension |
| 4336 | driven cam body extension upper end |
| 4340 | latch body |
| 4350 | striker body |

What is claimed is:

1. A variable-length axial linkage, comprising:

(a) a drive cam body;

(b) an intermediate cam body;

(c) a driven cam body; and (d) a latch mechanism;

wherein:

(e) the drive cam body and the intermediate cam body are threadingly engaged via a drive thread having a drive thread threadform and a drive thread lead angle;

(f) the drive thread threadform defines drive thread tension flanks having a drive thread tension flank angle;

(g) the linkage comprises a primary drive thread stop;

(h) the intermediate cam body and the driven cam body are threadingly engaged via a driven thread having a driven thread threadform and a driven thread lead angle;

(i) the linkage comprises a primary driven thread stop;

(j) a selected one of the drive thread and the driven thread is a left-handed thread;

(k) the non-selected one of the drive thread and the driven thread is a right-handed thread;

(l) the lead angles and threadforms of the drive thread and the driven thread are selected such that axial load transmitted through the linkage will urge the intermediate cam body to rotate;

(m) the primary drive thread stop is configured to be non-jamming and to limit the amount of rotation of the drive thread in a selected rotational direction; and (n) the primary driven thread stop is configured to be non-jamming and to limit the amount of rotation of the driven thread in the non-selected rotation direction.

2. The linkage as in claim 1, wherein the latch mechanism comprises a J-latch mechanism.

3. The linkage as claim 1, wherein the latch mechanism comprises:

(a) a latch body carried by the intermediate cam body and slidingly movable relative to the intermediate cam body between a latch body latching position and a free position on the intermediate cam body;

(b) a striker body carried by the driven cam body and slidingly movable relative to the driven cam body within defined limits; and (c) a first biasing means acting between the striker body and the driven cam body so as to urge the striker body toward a striker body latching position and engagement with the latch body;

wherein:

(d) the drive cam body has a drive cam body cam surface that is slidingly contactingly engageable with a latch body cam surface on the latch body such that:

movement of the drive cam body to a drive cam body latching position relative to the intermediate cam body will cause relative movement between the drive cam body cam surface and the latch body cam surface so as to move the latch body to the latch body latching position on the intermediate cam body and positively hold the latch body in the latch body latching position;

when the drive cam body is not in the drive cam body latching position, relative movement between the drive cam body cam surface and the latch body cam surface will allow the latch body to move to the free position on the intermediate cam body;

when the latch body is in the latch body latching position on the intermediate cam body, the latch body will be engageable with the striker body; and when the latch body is in the free position on the intermediate cam body, the latch body will not be engageable with the striker body; and (e) the latch body has a latch surface configured for mating engagement with a latch surface on the striker body, wherein:

said mating engagement of the said latch surfaces of the latch body and the striker body occurs when the latch body is in the latch body latching position, the striker body is in the striker body latching position, and the linkage is axially positioned at the limit of its operating range with both the primary drive thread stop and the primary driven thread stop engaged; and when the latch body and the striker body are in mating engagement, the latch body and the striker body will constrain relative rotation between the intermediate cam body and the driven cam body.

4. The linkage as in claim 3, wherein the angle of the tension flanks of the drive thread is selected to prevent free rotation under axial load reacted through the tension flanks of the drive thread.

5. The linkage as in claim 3, further comprising a second biasing means urging the latch body toward the free position on the intermediate cam body.

6. The linkage as in claim 5, further comprising a secondary driven thread stop, wherein a shoulder surface on the latch body and a shoulder surface on the driven cam body are configured for contacting engagement so as to limit an operating range of the driven thread in the selected rotational direction when the latch body is in the free position on the intermediate cam body.

7. The linkage as in claim 1, further comprising a secondary driven thread stop.

8. The linkage as in claim 1, further comprising a secondary drive thread stop.

9. The linkage as in claim 1, wherein at least one of the drive thread and the driven thread is a multi-start helical thread.

10. The linkage as in claim 1, wherein the linkage is an axial extension linkage.

11. The linkage as in claim 1, wherein the drive thread comprises an external thread on the drive cam body engaging an internal thread on the intermediate cam body, and the driven thread comprises an internal thread on the driven cam body engaging an internal thread on the intermediate cam body.

12. The linkage as in claim 1, wherein:

(a) the drive thread comprises an external thread on the drive cam body engaging an internal thread on the intermediate cam body; and (b) the driven thread comprises an external thread on the intermediate cam body engaging an internal thread on the driven cam body.

* * * * *